US007549882B2

(12) United States Patent
Kimura

(10) Patent No.: US 7,549,882 B2
(45) Date of Patent: Jun. 23, 2009

(54) CONNECTOR CAPABLE OF ABSORBING AN ERROR IN MOUNTING POSITION

(75) Inventor: Masaki Kimura, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 12/069,218

(22) Filed: Feb. 8, 2008

(65) Prior Publication Data

US 2008/0194130 A1 Aug. 14, 2008

(30) Foreign Application Priority Data

Feb. 9, 2007 (JP) ..... 2007-031202

(51) Int. Cl.
*H01R 13/62* (2006.01)

(52) U.S. Cl. ..... 439/260

(58) Field of Classification Search ..... 439/260, 439/631, 634, 637, 724, 862, 885
See application file for complete search history.

(56) References Cited

U.S. PATENT DOCUMENTS 4,878,862 A * 11/1989 Wise ..... 439/787
5,820,390 A * 10/1998 Takamoto et al. ..... 439/78
6,077,089 A * 6/2000 Bishop et al. ..... 439/66

FOREIGN PATENT DOCUMENTS

| | | |
|---|---|---|
| JP | 3-156872 | 7/1991 |
| JP | 10-326654 | 12/1998 |
| JP | 2000-12127 | 1/2000 |

OTHER PUBLICATIONS

Japanese Office Action dated Dec. 17, 2008.

* cited by examiner

*Primary Examiner*—Alexander Gilman
(74) *Attorney, Agent, or Firm*—Collard & Roe, P.C.

(57) ABSTRACT

In a connector for connecting two connection objects, each of contacts includes a first contacting portion to be connected to one of the connection objects, a first holding portion continuous from the first contacting portion, a second contacting portion to be connected to the other connection object, a second holding portion continuous from the second contacting portion, and a connecting portion connecting the first holding portion and the second holding portion. A housing holding the contacts includes a first housing holding the first holding portion and receiving the first contacting portion and a second housing separate from the first housing, holding the second holding portion, and receiving the second contacting portion. The first housing is held by the connecting portion to be movable relative to the second housing in a fitting and removing direction with the connection object or a direction intersecting the fitting and removing direction.

19 Claims, 36 Drawing Sheets

CONNECTOR CAPABLE OF ABSORBING AN ERROR IN MOUNTING POSITION

This application claims priority to prior Japanese patent application JP2007-31202, filed on Feb. 9, 2007, the disclosure of which is incorporated herein in its entirety by reference.

TECHNICAL FIELD

This invention relates to a card edge connector for use in a personal computer or a printer to connect a module board (such as a card board of a graphic card) onto a main board (such as a mother board) and, in particular, to a double-ended card edge connector having card edge receiving portions on opposite ends thereof.

BACKGROUND ART

As a connector for connecting a card board (a module board, a subsidiary board) of a graphic card and a main board (such as a mother board), a card edge connector is used. The card edge connector includes a contacting portion fitted to the card board and a terminal portion which has a shape of a surface mount (SMT) terminal or a through hole and is connected to the mother board.

However, the card edge connector does not have a part for absorbing an error in mounting position when each of the card board and the mother board is mounted to a housing or another board. Therefore, the card edge connector may be subjected to a mechanical load to be broken or the card board may be undesirably bent. This results in a problem that the mechanical load is also applied to various parts mounted on the card board and a solder at a mounting portion may possibly be separated or detached. In addition, the card board and the mother board must be moved up and down in a thickness direction.

As a connector for directly connecting a board and another board to each other, a double-ended card edge connector is proposed. The double-ended card edge connector comprises a housing having openings formed on opposite ends thereof, and a plurality of contacts to be connected to a plurality of conductive pads formed on opposite surfaces at an end portion of each of the boards (for example, see Japanese Unexamined Patent Application Publication (JP-A) No. H3-156872 and Japanese Unexamined Patent Application Publication (JP-A) No. 2000-12127).

However, the double-ended card edge connector described above does not have a structure for absorbing, by the connector itself, an error in positioning of a subsidiary board and a main board with respect to each other. Further, because of the structure of the connector, the subsidiary board and the main board must be different in position in the thickness direction. Furthermore, in case of the structure in which a contact of the card edge connector is fixed to a housing, the contact must be provided with a protruding portion formed between the contacting portion and the terminal portion and having a press-fit part to be fixed to the housing. Under the influence of the protruding portion, characteristic impedance is significantly lowered.

Furthermore, if a plurality of contacts are arranged at a narrow pitch, a distance between signal contacts becomes small. Therefore, characteristic impedance is inevitably lowered.

The contact of the card edge connector is different in shape between the contacting portion to be connected to the conductive pad of the card board and the terminal portion to be mounted to the mother board. Therefore, it is difficult to match the characteristic impedance because the impedance value is different between the case where a signal is supplied through the contacting portion to be connected to the card board and the case where a signal is supplied through the terminal portion to be mounted to the mother board.

In case of the narrow pitch, misalignment between the card board and the connector causes a significant problem. For example, the contacting portion of the contact may possibly be brought into contact not only with a corresponding conductive pad of the card board but also with a next adjacent pad to cause short-circuiting to occur.

Furthermore, in order to produce a highly-reliable product in view of limitation in pad width and a pitch error, a relatively wide pitch is required so that miniaturization is difficult.

SUMMARY

It is therefore an exemplary object of this invention to provide a connector capable of absorbing an error in mounting position.

Other objects of the present invention will become clear as the description proceeds.

According to an exemplary aspect of the present invention, there is provided a connector for connecting two connection objects, comprising a plurality of contacts and a housing holding the contacts, wherein each of the contacts includes a first contacting portion to be connected to one of the connection objects, a first holding portion continuous from the first contacting portion, a second contacting portion to be connected to the other connection object, a second holding portion continuous from the second contacting portion, and a connecting portion connecting the first holding portion and the second holding portion, wherein the housing comprises a first housing holding the first holding portion and receiving the first contacting portion and a second housing separate from the first housing, holding the second holding portion, and receiving the second contacting portion; and wherein the first housing is held by the connecting portion to be movable relative to the second housing in a fitting and removing direction with the connection object or a direction intersecting the fitting and removing direction.

EXEMPLARY EMBODIMENTS

Figure 1:
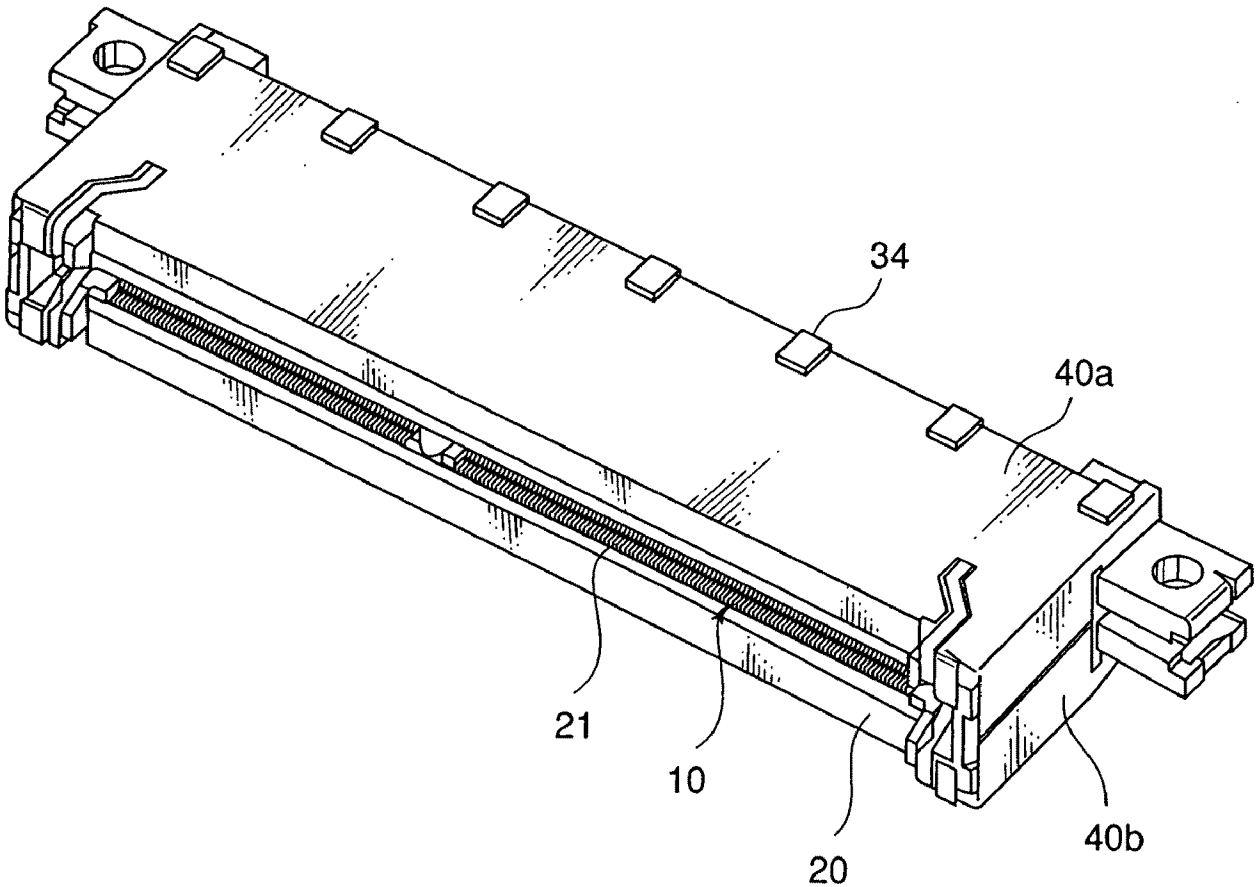
FIG. 1 is a perspective view of a double-ended card edge connector as a connector according to a first exemplary embodiment of this invention.

Now, various exemplary embodiments of this invention will be described with reference to the drawing. In the following description, it is assumed that a subsidiary board (module board) and a main board as two objects to be connected are a card board and a mother board, respectively. A side to be fitted to the card board 51 and the other side to be fitted to the mother board 52 will be called a front side and a rear side, respectively.

At first referring to FIGS. 1 to 10C, description will be made of a double-ended card edge connector as a connector according to a first embodiment of this invention.

Referring to FIGS. 1 to 8, the double-ended card edge connector 100 comprises a first housing 20 made of an insulating material having a box-like shape elongated in a widthwise direction, a second housing 30 spaced from the first housing 20 and made of an insulating material having a box-like shape elongated in the widthwise direction, like the first housing 20, a plurality of contacts 10 having end portions received in the first and the second housings 20 and 30 so as to connect the first and the second housings 20 and 30 in a forward-backward direction, and a pair of shells 40*a* and 40*b* (collectively depicted by 40) made of metal and covering upper and lower sides of a double-ended card edge connector body. In the following description, the double-ended card edge connector body without the shell 40 and the double-ended card edge connector having the shell 40 are collectively represented by a reference numeral 100.

Figure 7:
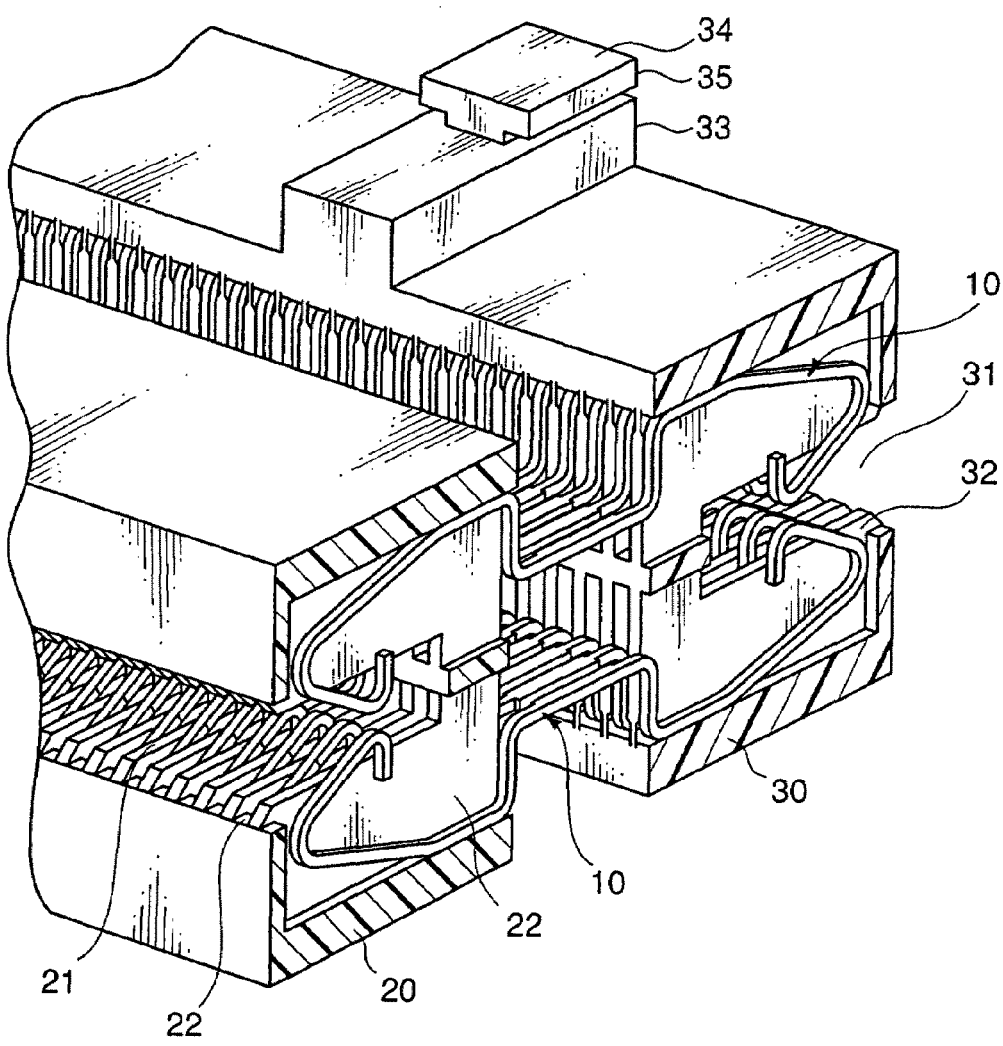
FIG. 7 is an enlarged sectional perspective view of a part of the connector body illustrated in FIG. 2.
Figure 8:
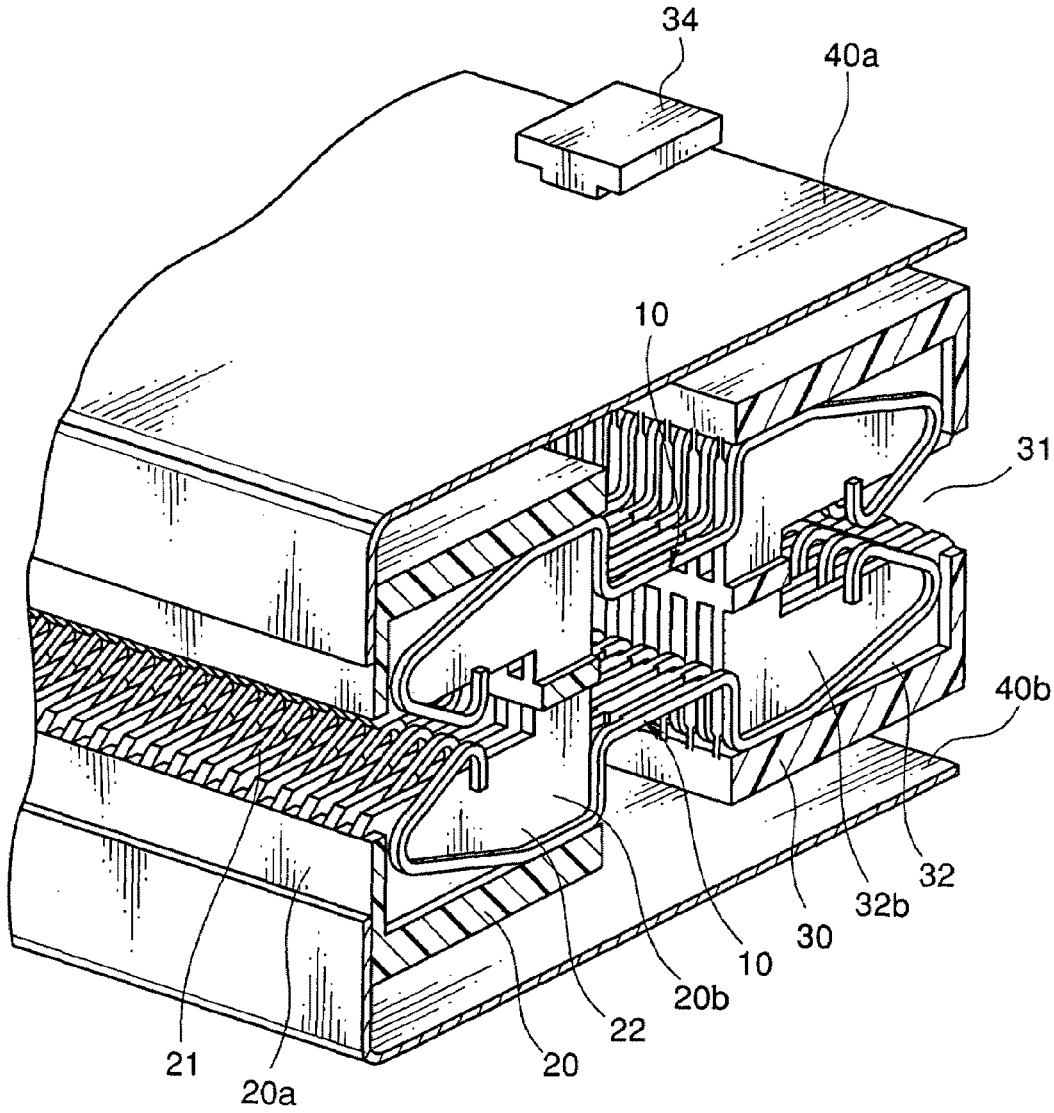
FIG. 8 is an enlarged sectional perspective view of a part of the double-ended card edge connector illustrated in FIG. 1.

As best shown in FIGS. 7 and 8, the first housing 20 has an opening 21 formed at its one end, having a rectangular section, and continuously extending in the widthwise direction. The opening 21 is adapted to receive one end of the card board 51 having a plurality of conductive pads formed on opposite surfaces at its end portion. Continuous from and around the opening 21, a plurality of grooves or receiving portions 22 equal in number to the contacts 10 and receiving one ends of the contacts 10 are formed in parallel to one another in the widthwise direction and arranged in upper and lower rows. Each of the receiving portions 22 has a box-like shape and is opened at its center.

The second housing 30 has an opening 31 formed at its one end, having a rectangular section, and elongated in the widthwise direction. The opening 31 is adapted to receive one end of the mother board 52 having a plurality of conductive pads formed on opposite surfaces at its end portion. Continuous from and around the opening 31, a plurality of grooves or receiving portions 32 equal in number to the contacts 10 and receiving the other ends of the contacts 10 are formed in parallel to one another in the widthwise direction and arranged in upper and lower rows. Each of the receiving portions 32 has a box-like shape and is opened at its center. The second housing 30 has an upper surface provided with a plurality of step portions 33 for supporting the shell 40*a*, and a plurality of protruding portions 34 each having a T-shaped section and adapted to fix the shell 40*a*. Each of the protruding portions 34 has a pair of grooves formed on opposite sides at its lower part and adapted to be fitted to shell fixing portions 49 (see FIG. 36).

As best shown in FIGS. 9 and 10A-10C, the contacts 10 are arranged in a pair of rows, i.e., upper and lower rows to be symmetrical in the vertical direction. Herein, those contacts 10 arranged in the upper row will be called first contacts 10 while those contacts 10 arranged in the lower row will be called second contacts 10. Each of the first and the second contacts 10 has first and second contacting portions 1 and 2 each having a V shape or a U shape and formed on opposite ends thereof, respectively, first and second spring portions 3 and 4 each having an L shape and connected to bases of the first and the second contacting portions 1 and 2, respectively, first and second holding portions 5 and 6 continuous from the first and the second spring portions 3 and 4, respectively, and a U-shaped floating portion 11 connecting one ends of the first and the second holding portions 5 and 6 faced to each other. Each of the first and the second contacts 10 has press-fit portions 5*a* and 6*a* formed on opposite sides of the floating portion 11 in the vicinity thereof to be press-fitted to the receiving portions 22 and 32 of the first and the second housings 20 and 30, respectively. The floating portion 11 has a pair of first and second vertical portions 7 and 8 extending from one ends of the first and the second holding portions 5 and 6 in a direction perpendicular thereto, and a connecting portion or an intermediate portion 9 connecting extending ends of the first and the second vertical portions 7 and 8. The first and the second contacting portions 1 and 2 are smaller in width than the first and the second spring portions 3 and 4. The intermediate portion 9 of the floating portion 11 has a center portion 9*a* wider than the first and the second spring portions 3 and 4 and the first and the second holding portions 5 and 6.

The first and the second contacting portions 1 and 2 of the first contacts 10 (upper contacts) are adapted to be contacted with the pads formed on the upper surfaces at end portions of the card board 51 and the mother board 52, respectively. On the other hand, the first and the second contacting portions 1 and 2 of the second contacts 10 (lower contacts) are adapted to be contacted with the pads formed on the lower surfaces at end portions of the card board 51 and the mother board 52, respectively.

Each of the first and the second contacts 10 has a symmetrical or analogous shape with respect to the floating portion 11 at the center in its longitudinal direction. Therefore, the same impedance characteristic can be achieved whether a signal is supplied through the first contacting portion 1 or the second contacting portion 2.

Furthermore, the floating portion 11 located in the middle of each of the first and the second contacts 10 has folded portions at positions between the first and the second vertical portions 7 and 8 and the intermediate portion 9 where the contacting portions 1 and 2 are changed in extending direction. With this structure, fitting surfaces of the first and the second housings 20 and 30 can be floated in an increased number of directions.

Figure 9:
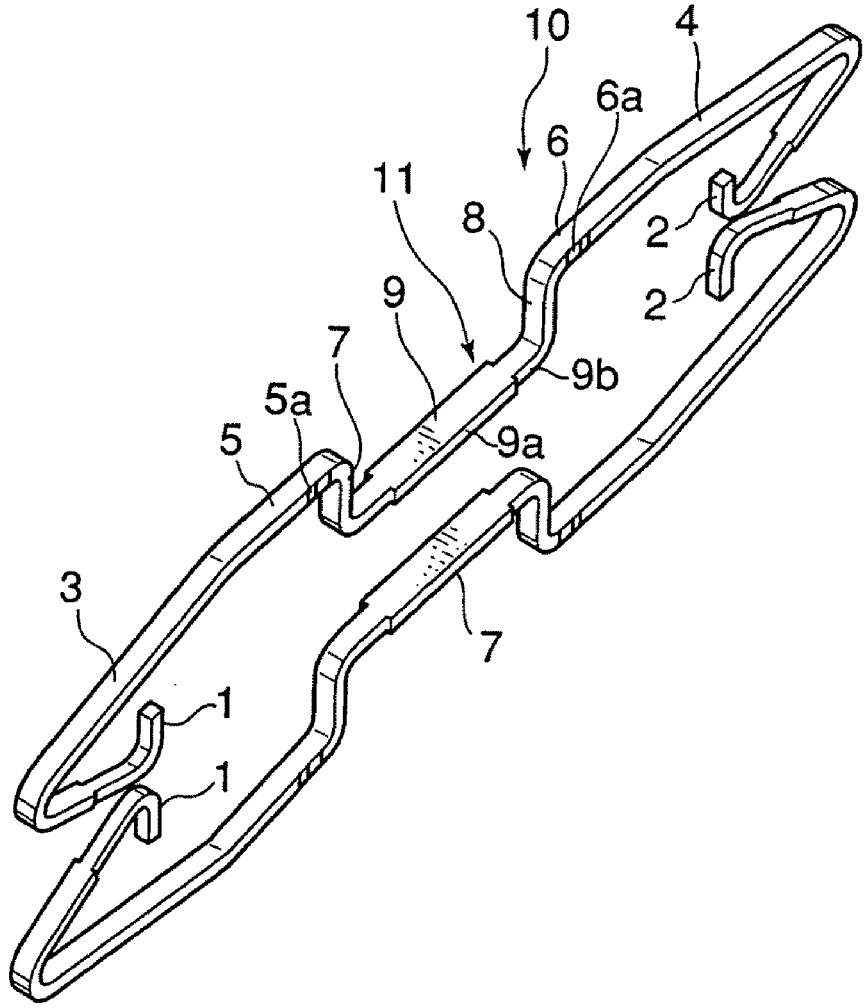
FIG. 9 is a perspective view of a pair of contacts of the double-ended card edge connector illustrated in FIG. 1.
Figure 10A:
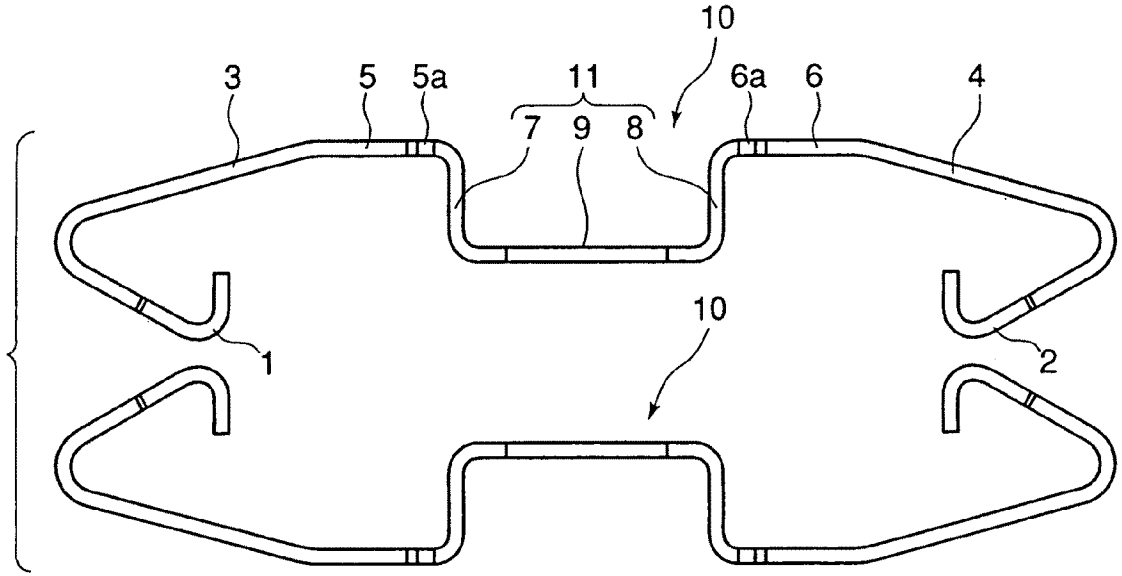
FIG. 10A is a front view of the contacts in FIG. 9.
Figure 10B:
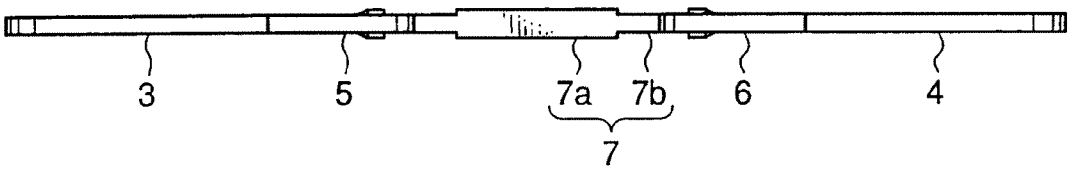
FIG. 10B is a bottom view of the contacts in FIG. 9.
Figure 10C:
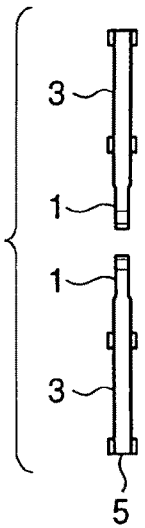
FIG. 10C is a left side view of the contacts in FIG. 9.

As described above, the double-ended card edge connector of the related art is disadvantageous in that, if the contacts are arranged at a narrow pitch, misalignment between the card board and the connector causes a significant problem. For example, the contacting portion of the contact may possibly be brought into contact not only with a corresponding conductive pad of the card board but also with a next adjacent pad to cause short-circuiting to occur. On the other hand, in the double-ended card edge connector 100 in this embodiment, the first and the second contacts 10 are reduced in width only at the first and the second contacting portions 1 and 2 exposed out of the receiving portions 22 and 32 of the first and the second housings 20 and 30 as illustrated in FIG. 9. Thus, without causing significant loss in characteristic impedance and in spring property, short-circuiting between adjacent ones of the first and the second contacting portions 1 and 2 is prevented by narrowing only those parts to be contacted with the pads.

As described above, in order to produce a highly-reliable product in view of limitation in pad width and a pitch error, a relatively wide pitch of the contacts is required in the double-ended card edge connector of the related art. On the other hand, with the above-mentioned structure of the double-ended card edge connector 100, it is possible to achieve a narrow pitch of the first and the second contacts 10 while keeping the reliability.

Figure 4:
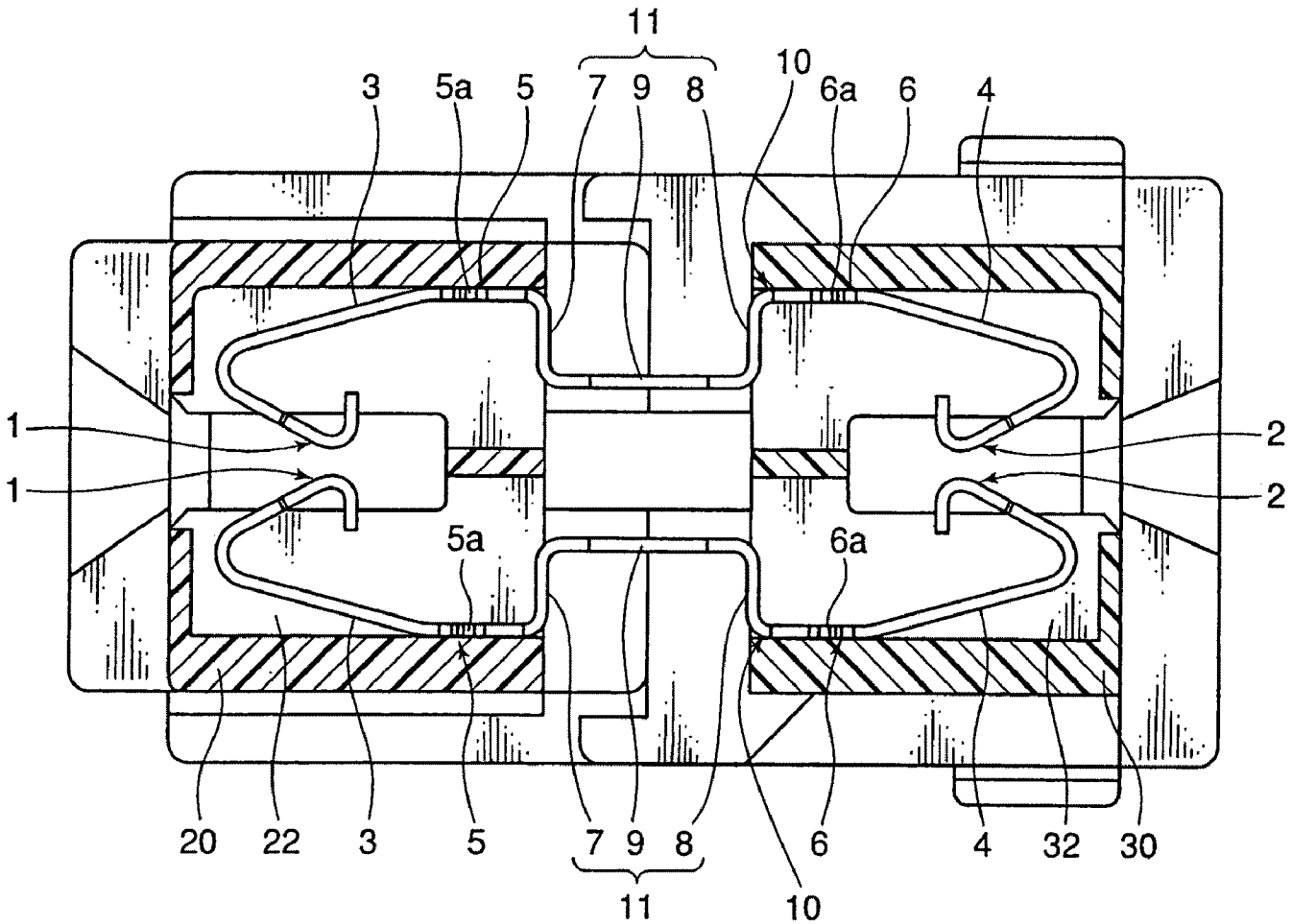
FIG. 4 is a sectional view taken along a line IV-IV in FIG. 3A.

As best shown in FIG. 4, one ends of the first and the second contacts 10 are inserted into the receiving portion 22 of the first housing 20 from the other end of the housing 20 and held by the press-fit portions 5*a*. Similarly, the other ends of the first and the second contacts 10 are inserted into the receiving portion 32 of the second housing 30 from the other end of the housing 30 and held by the press-fit portions 6*a*. The contacting portions 1 and 2 of the first and the second contacts 10 are exposed in the openings 21 and 31, respectively. The first contacting portions 1 of each pair of the first and the second contacts 10 are faced to each other in the vertical direction. Likewise, the second contacting portions 2 of each pair of the first and the second contacts 10 are faced to each other in the vertical direction. The first and the second contacts 10 are arranged symmetrically in the vertical direction.

In the card-edge connector of the related art, if the contacts are arranged at a narrow pitch, a distance between signal contacts becomes small so that the characteristic impedance is inevitably lowered.

On the other hand, in the double-ended card edge connector 100 in this embodiment, the floating portion 11 of the contact 10 has an exposed portion so that the characteristic impedance is increased. Thus, the problem of decrease in characteristic impedance in the related art is solved.

The first and the second contacts 10 are press-fitted to the first and the second housings 20 and 30 to be fixed thereto, respectively. For this purpose, each of the first and the second contacts 10 is provided with the folded portions formed as the intermediate portion 9 or the floating portion 11 between the press-fit portions 5*a* and 6*a* where the contact 10 is changed in extending direction. In order to press-fit the contact 10 into the first and the second housings 20 and 30, the contact 10 can be forced into the first and the second housings 20 and 30 by pressing the folded portions.

Figure 5:
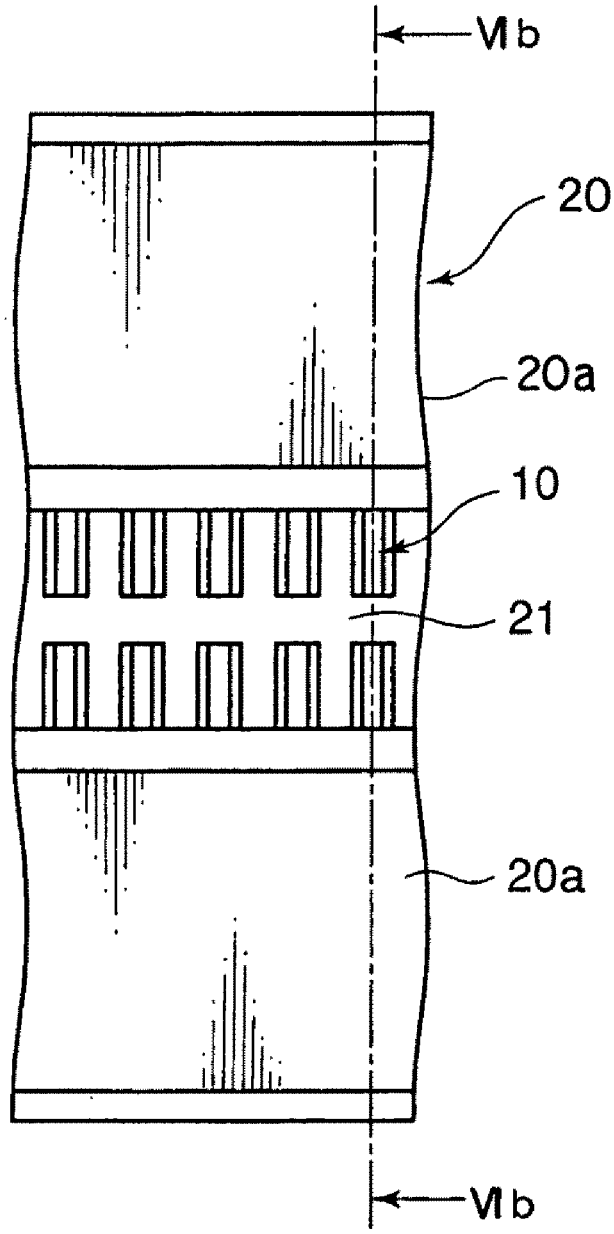
FIG. 5 is a front view of a part of the connector body illustrated in FIG. 3A.

As shown in FIG. 5, the first housing 20 may be provided with first and second front walls 20*a* formed at its front side to define the opening 21 as a board insertion slot. The first and the second front walls 20*a* serve to enhance the strength of the board insertion slot or the opening 21. The second housing 30 may be provided with structure similar to the first housing 20.

Figure 6:
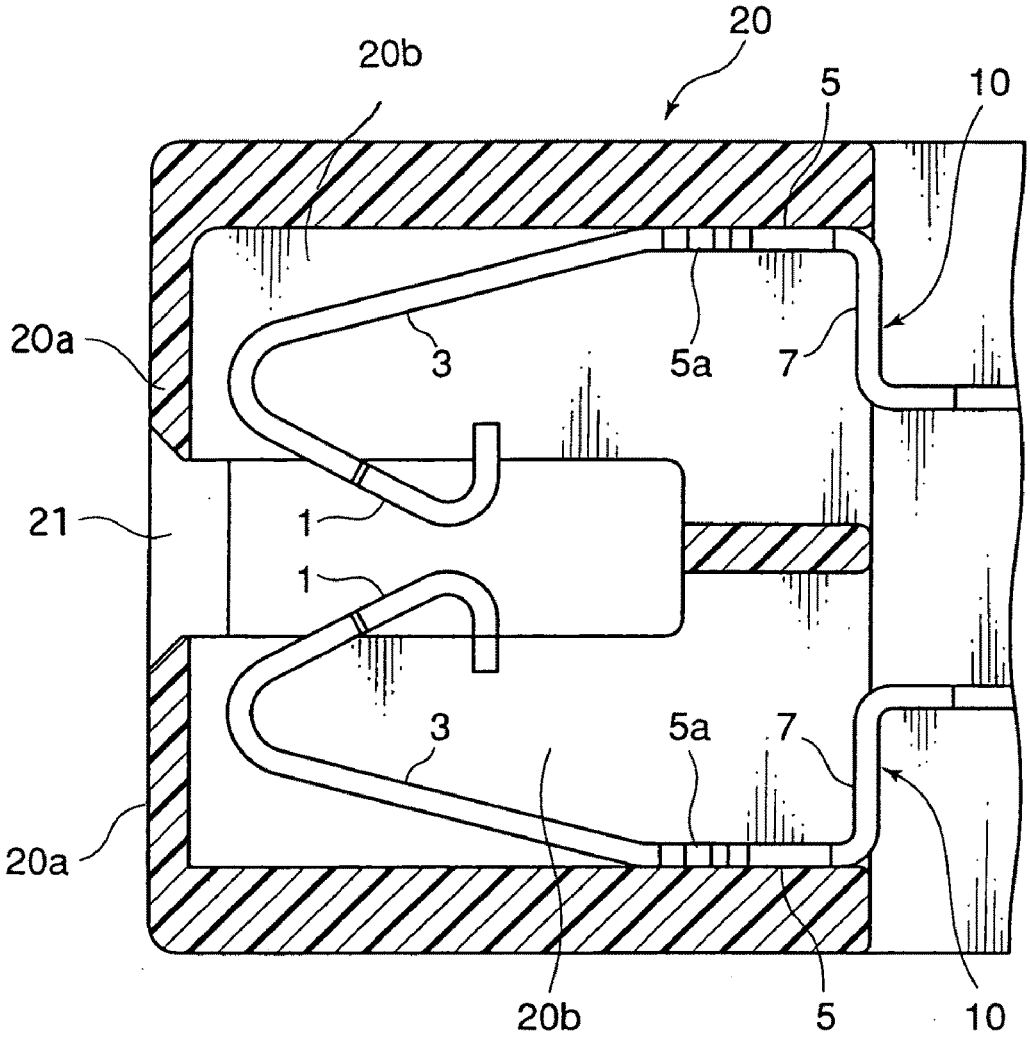
FIG. 6 is a sectional view taken along a line VIb-VIb in FIG. 5.

As shown in FIG. 6, a plurality of ribs 20*b* may be provided in the first housing 20 to separate the receiving portion 22. The second housing 30 may also be provided with ribs similar to the ribs 20*b* of the first housing 20.

The mother board 52 has a pad structure similar to that of the card board 51. By the use of the double-ended card edge connector in order to connect the card board 51 and the mother board 52, it is possible to eliminate a soldering step and to easily perform mounting or exchange of the connector.

Referring to FIGS. 11 to 14, description will be made of an operation and the state of use of the double-ended card edge connector 100 described above.

Figure 14:
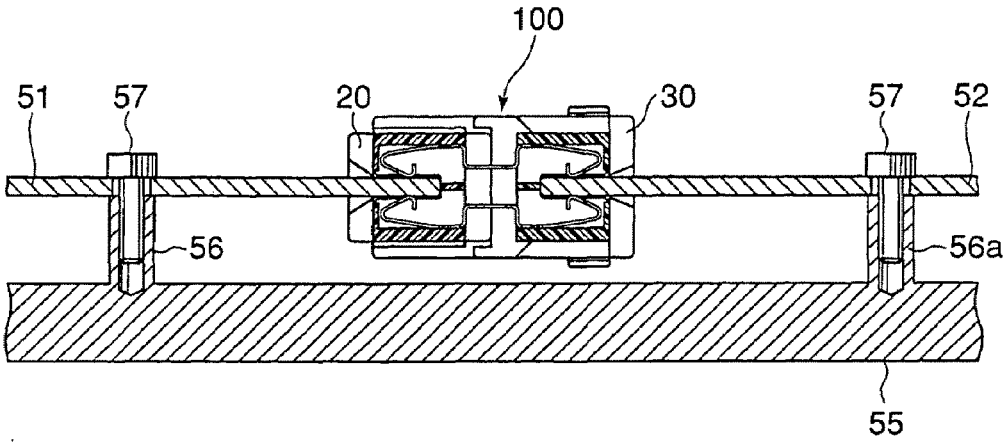
FIG. 14 is a sectional view for describing the state of use of the double-ended card edge connector in FIG. 1.

As illustrated in FIG. 14, the double-ended card edge connector 100 is mounted to a housing 55 of an electronic component or the like. One end of the card board 51 is inserted into the first housing 20 at one end of the double-ended card edge connector 100. On the other hand, one end of the mother board 52 is inserted into the second housing 30 at the other end of the double-ended card edge connector 100. The card board 51 is fixed by a fixing screw 57 to a cylindrical fixing portion 56 protruding on an upper surface of the housing 55 near its one end. The mother board 52 is fixed by another fixing screw 57 to another cylindrical fixing portion 56 protruding on the upper surface of the housing 55 near its the other end, in the manner similar to the card board 51.

Figure 11:
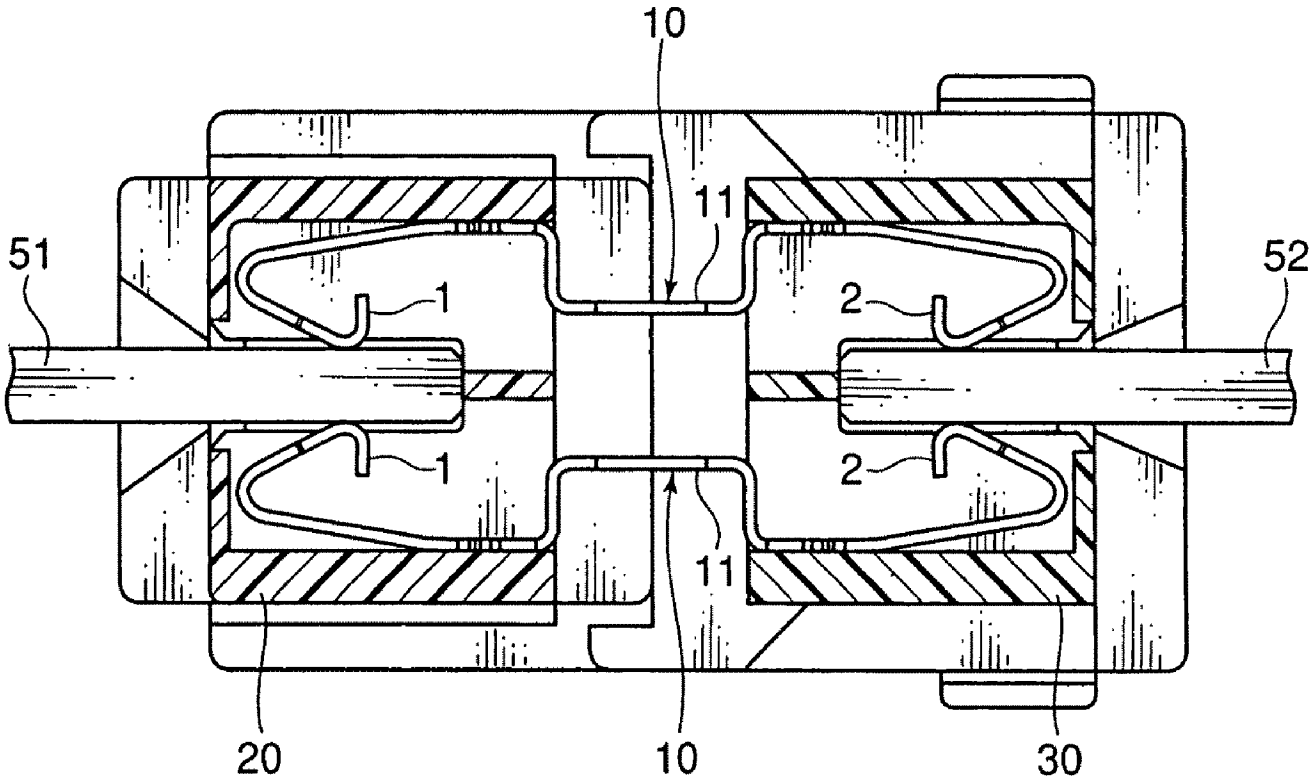
FIGS. 11 to 13 are sectional views for describing an operation of the double-ended card edge connector in FIG. 1.

Referring to FIG. 11, description will be made of connection by the double-ended card edge connector in case where no level difference is present between the card board 51 and the mother board 52.

Figure 12:
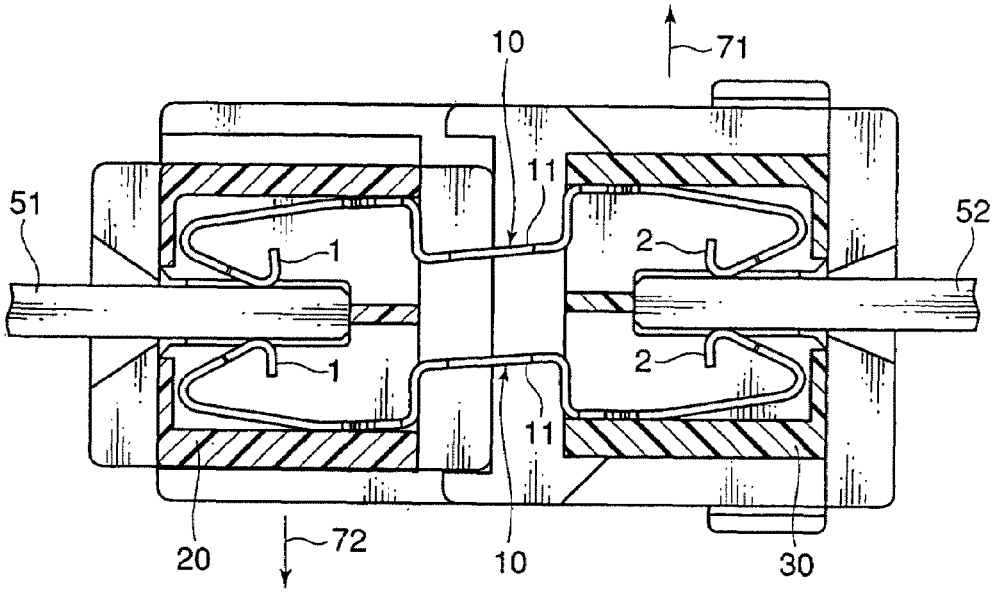

As illustrated in FIG. 12, it is assumed that, from the state illustrated in FIG. 9, the mother board 52 is lifted upward relative to the card board 51 as depicted by arrows 71 and 72 to cause a floating state. In this case, the U-shaped floating portions 11 of the contacts 10 are deformed so that the right sides in the figure are heightened in level. Therefore, connection can be maintained.

Figure 13:
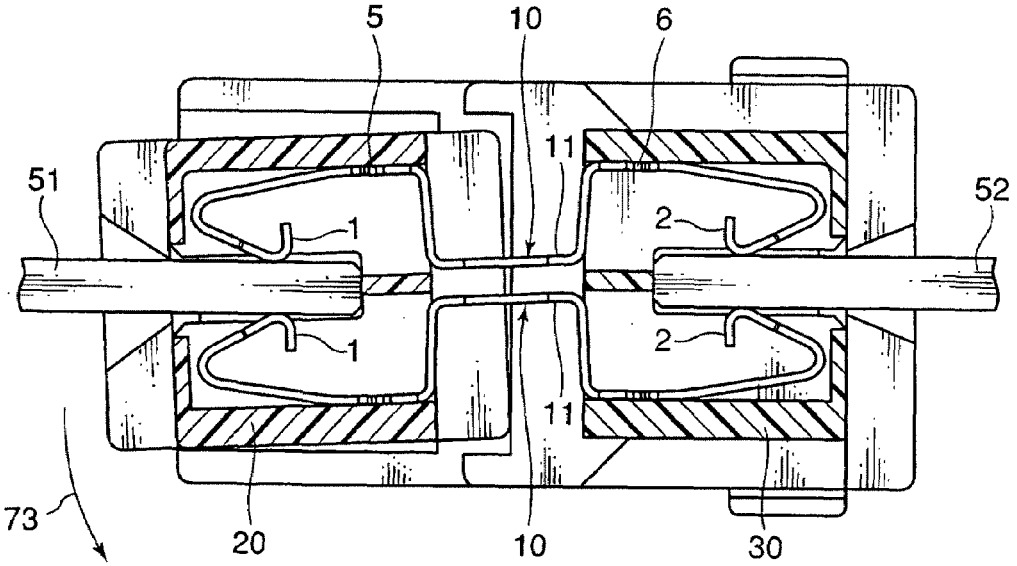

As illustrated in FIG. 13, it is assumed that the card board 51 is applied with a force to be rotated counterclockwise relative to the mother board 52 as depicted by an arrow 73 to cause a floating state. In this case also, the U-shaped floating portion 11 of the first contact 10 in the upper row is deformed to be opened while the U-shaped floating portion 11 of the second contact 10 in the lower row is deformed to be closed. Therefore, connection can be maintained.

The double-ended card edge connector 100 includes, on each of its opposite ends, structure similar to a card edge connector known in the art. Therefore, it is necessary to suppress a mounting error when each of the card board 51 and the mother board 52 is mounted to the housing 55. In the double-ended card edge connector 100 in this embodiment, a housing of the double-ended card edge connector 100 comprises two housings, i.e., the first and the second housings 20 and 30 arranged adjacent in the forward-backward direction. The first and the second housings 20 and 30 are allowed to be floated at the center of the connector 100. In other words, the fitting surfaces in the double-ended card edge connector are allowed to be moved at least in one direction so that an error in mounting position can be absorbed by the connector.

In the double-ended card edge connector 100, the card board 51 and the mother board 52 can be arranged on a single plane. The contact 10 has the folded portions formed at its intermediate portion and folded in a direction perpendicular to the direction from the first contacting portion 1 to be contacted with the card board 51 towards the second contacting portion 2 to be contacted with the mother board 52. With this structure, the fitting surfaces can be floated in directions along which the card board 51 and the mother board 52 move toward each other or away from each other.

Figure 15:
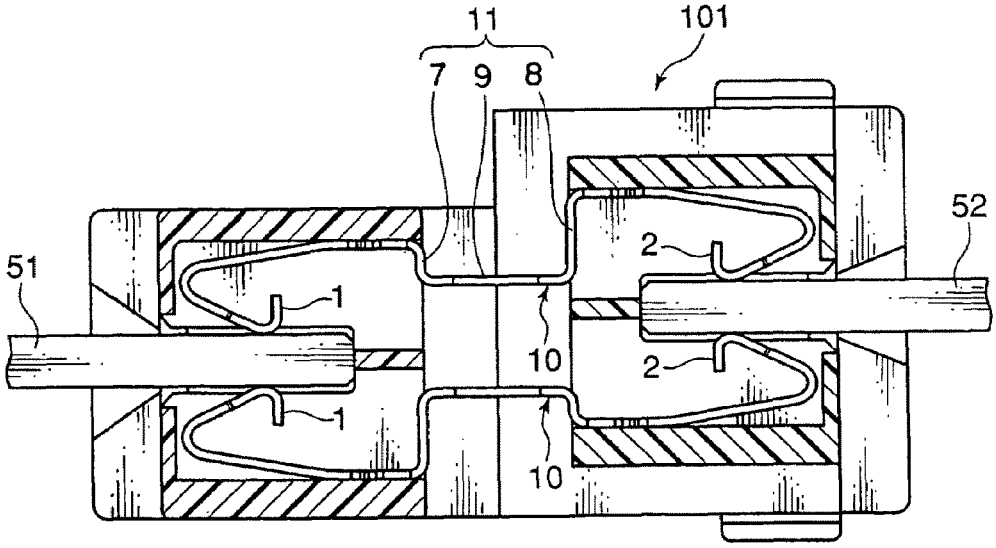
FIG. 15 is a sectional view of a double-ended card edge connector as a connector according to a second exemplary embodiment of this invention.

Referring to FIG. 15, description will be made of a double-ended card edge connector as a connector according to a second embodiment of this invention.

The double-ended card edge connector 101 illustrated in FIG. 15 is different from the double-ended card edge connector 100 in the first embodiment in that the second housing 30 has a height greater than that of the first housing 20. In the first contact 10 in the upper row, the first vertical portion 7 of the floating portion 11 is shorter than the second vertical portion 8. On the other hand, in the second contact 10 in the lower row, the second vertical portion 8 of the floating portion 11 is shorter than the first vertical portion 7. The first vertical portion 7 of the first contact 10 in the upper row is equal in length to the second vertical portion 8 of the second contact 10 in the lower row. The second vertical portion 8 of the first contact 10 in the upper row is equal in length to the first vertical portion 7 of the second contact 10 in the lower row.

The double-ended card edge connector 101 illustrated in FIG. 15 is applied to the case where the card board 51 and the mother board 52 are decentered with respect to each other, for example, in the vertical direction.

The double-ended card edge connector 101 has operations and effects similar to those of the double-ended card edge connector 100 except that mentioned above.

Figure 16:
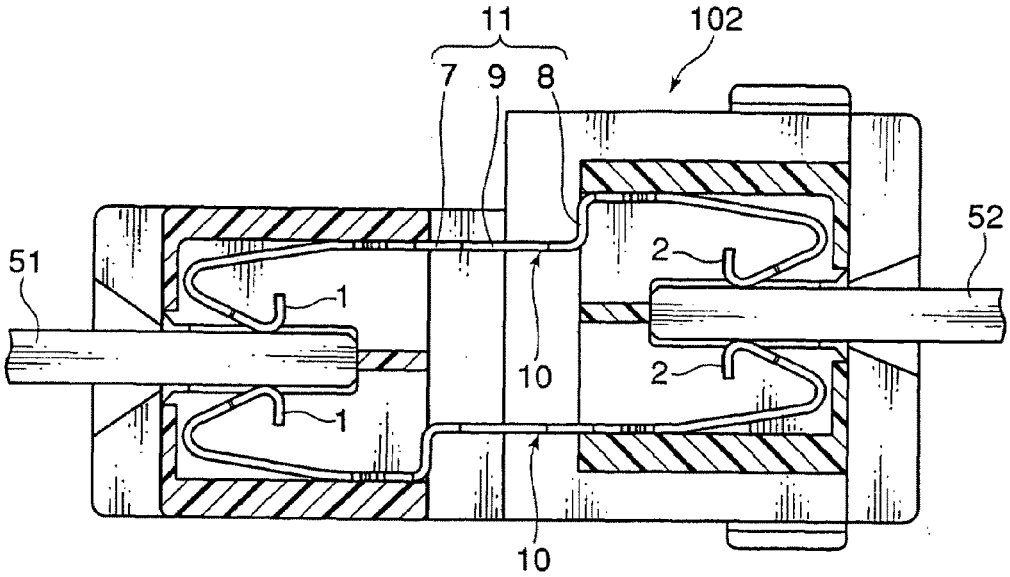
FIG. 16 is a sectional view of a double-ended card edge connector as a connector according to a third exemplary embodiment of this invention.

Referring to FIG. 16, description will be made of a double-ended card edge connector as a connector according to a third embodiment of this invention.

In the double-ended card edge connector 102 illustrated in FIG. 16, the second housing 30 has a height greater than the first housing 20, like in FIG. 15. The floating portion 11 of the first contact 10 in the upper row does not have the first vertical portion 7. The floating portion 11 of the second contact 10 in the lower row does not have the second vertical portion 8.

The double-ended card edge connector 102 in FIG. 16 is applied to the case where the card board 51 and the mother board 52 are decentered with respect to each other, for example, in the vertical direction, like the double-ended card edge connector 101 in FIG. 15.

The double-ended card edge connector 102 in FIG. 16 has operations and effects substantially similar to those of the double-ended card edge connectors 100 and 101 mentioned above.

Figure 17:
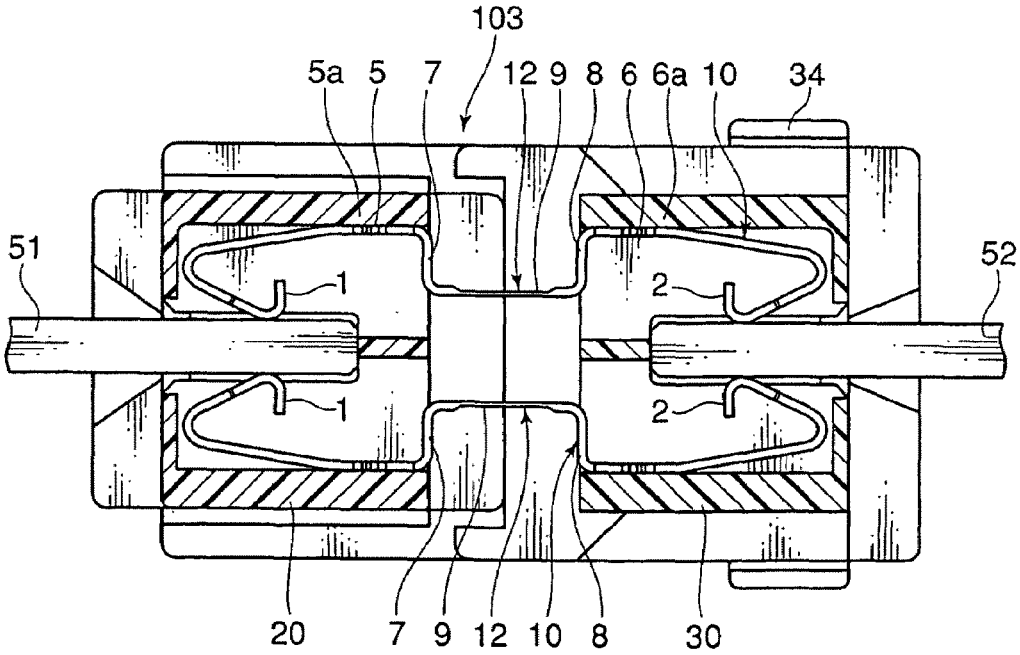
FIG. 17 is a sectional view of a double-ended card edge connector as a connector according to a fourth exemplary embodiment of this invention.

Referring to FIG. 17, description will be made of a double-ended card edge connector as a connector according to a fourth embodiment of this invention.

The double-ended card edge connector 103 illustrated in FIG. 17 is different from the double-ended card edge connector 100 according to the first embodiment except that each of a pair of the first and the second contacts 10 in the upper and the lower rows has a floating portion 12 reduced in thickness at the intermediate portion 9. Thus, in each of the first and the second contacts 10, the intermediate portion 9 of the floating portion 12 is reduced in thickness, i.e., reduced in sectional area. With this structure, more flexible floating is possible and the fitting surfaces are easily floated. In other words, the first and the second contacts 10 are easily bendable.

Figure 18:
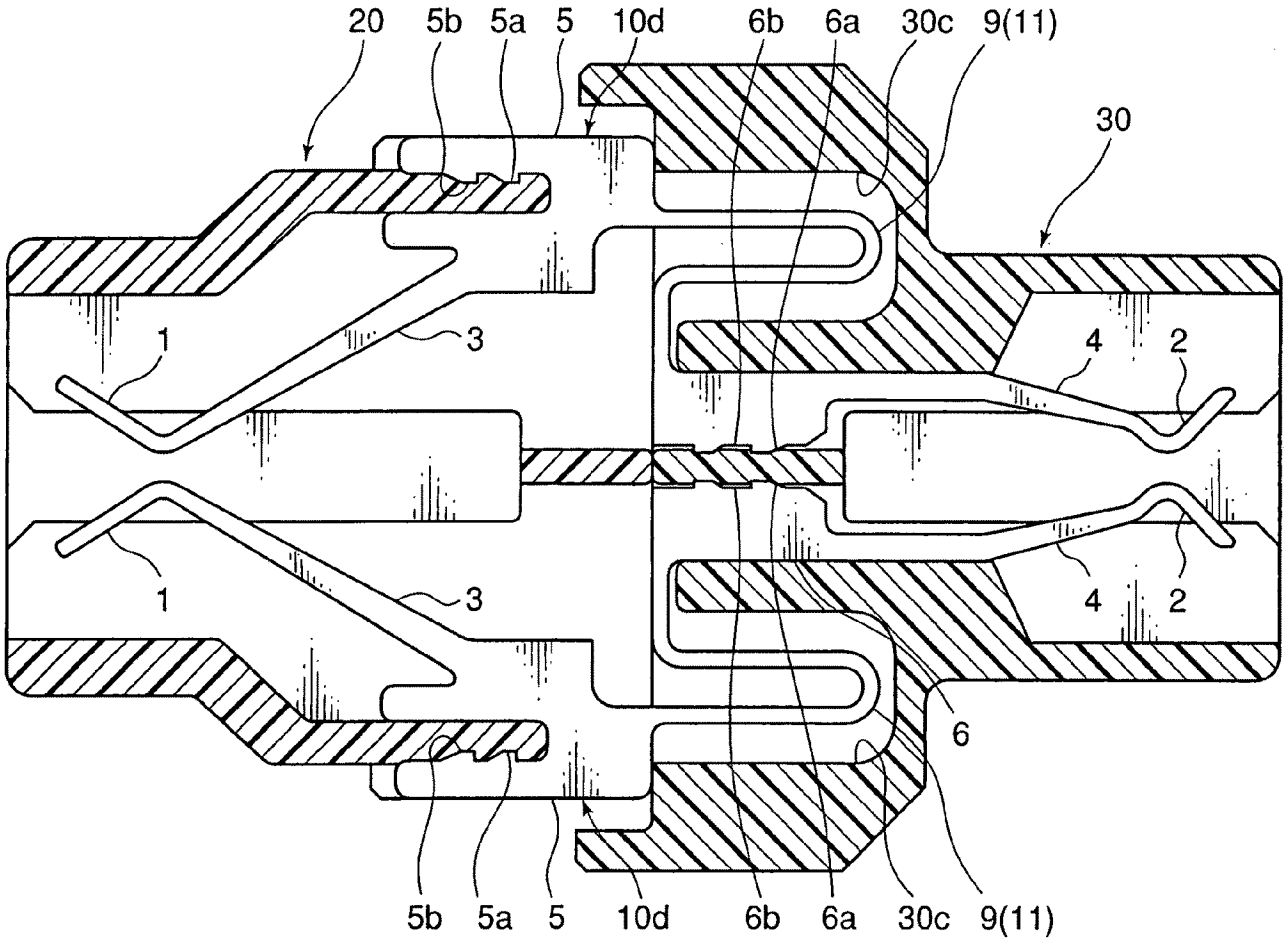
FIG. 18 is a sectional view of a double-ended card edge connector as a connector according to a fifth exemplary embodiment of this invention.
Figure 19:
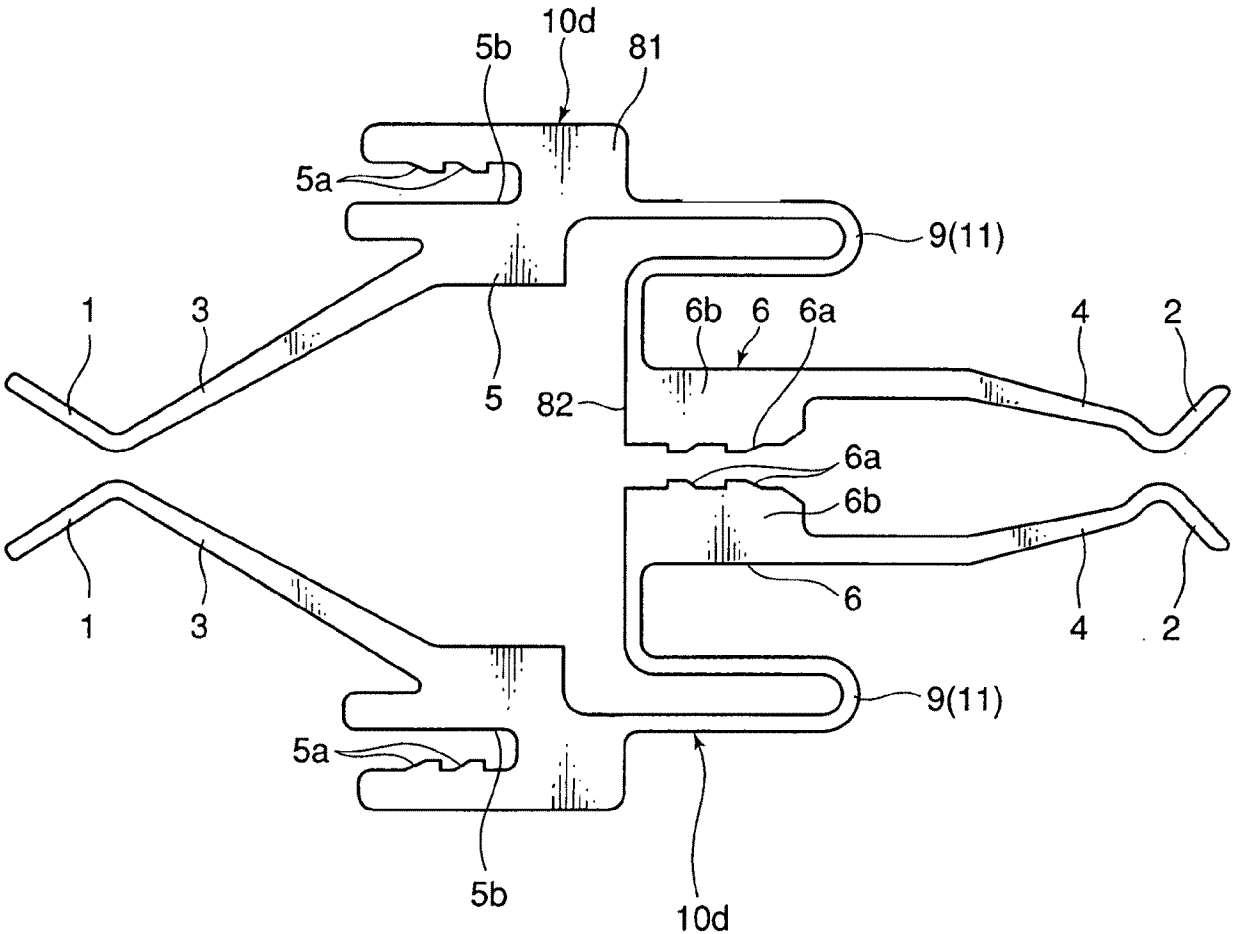
FIG. 19 is a side view of contacts of the double-ended card edge connector illustrated in FIG. 18.

Referring to FIGS. 18 and 19, description will be made of a double-ended card edge connector as a connector according to a fifth embodiment of this invention.

The double-ended card edge connector illustrated in FIG. 18 is different from those of the first through the fourth embodiments in that each of contacts 10*d* illustrated in FIG. 19 has a different shape. Specifically, each of the first and the second contacts 10*d* in upper and lower rows has first and second contacting portions 1 and 2, first and second spring portions 3 and 4, first and second holding portions 5 and 6 continuous therefrom, and an intermediate portion 9 connecting the first and the second holding portions 5 and 6. The first holding portion 5 has a groove 5*b* adapted to be press fitted over an outer peripheral wall of the first housing 20, and a press-fit portion 5*a* formed outside the groove 5*b*. The second holding portion 6 has a wide portion 6*b* and a press-fit portion 6*a* formed inside the wide portion 6*b* so as to be press-fitted inside the second housing 30. The intermediate portion 9 between the first and the second holding portions 5 and 6 has a generally U shape extending straight from the second holding portion 6 on the outside in the vertical direction, bent to extend towards the second contacting portion 2, and turned around towards the first holding portion 5 to reach the first holding portion 5. The intermediate portion 9 is inserted into a receiving portion 30*c* of the second housing 30.

In order to hold the first and the second contacts 10*d* in the first and the second housings 20 and 30, folded portions where the contacts 10*d* are changed in extending direction are formed at the center between the press-fit portions 5*a* and 6*a*. Therefore, the first housing 20 is movable with respect to the second housing 30 not only in the vertical direction but also in the transversal direction and the fitting direction.

In order to press-fit the contact 10*d* into the first and the second housings 20 and 30, the contact 10*d* can be forced into the first and the second housings 20 and 30 by pressing those portions 81 and 82 near the folded portions.

Figure 20:
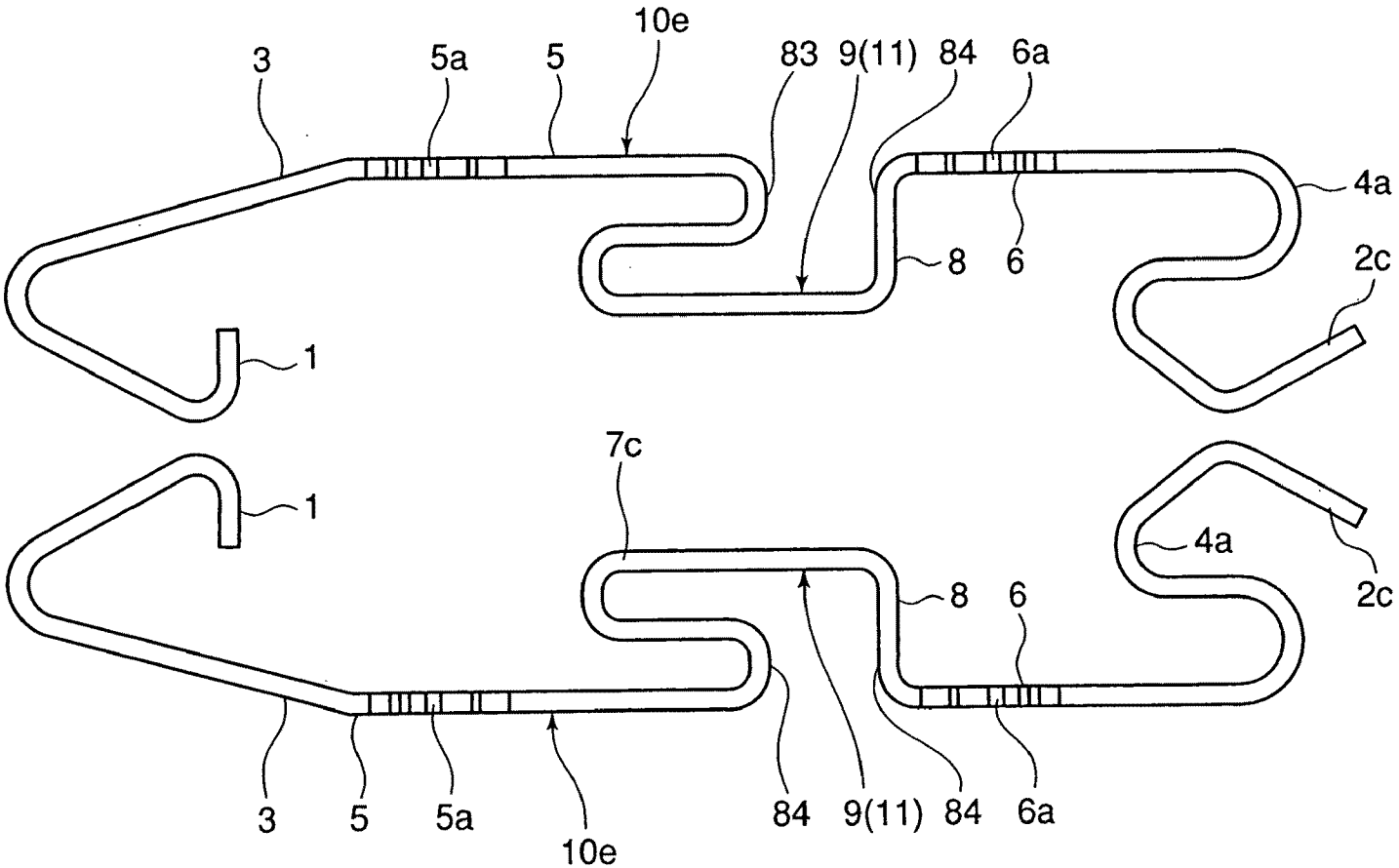
FIG. 20 is a side view of contacts of a double-ended card edge connector as a connector according a sixth exemplary embodiment of this invention.

Referring to FIG. 20, description will be made of a double-ended card edge connector as a connector according to a sixth embodiment.

The double-ended card edge connector in the sixth embodiment is different from those of the first through the fourth embodiments in that each of contacts 10*e* has a different shape. Specifically, each of the first and the second contacts 10*e* in upper and lower rows has first and second contacting portions 1 and 2, first and second spring portions 3 and 4, first and second holding portions 5 and 6 continuous therefrom, and an intermediate portion 9 connecting the first and the second holding portions 5 and 6. The first holding portion 5 has a pair of press-fit portions 5*a* formed on opposite sides in the widthwise direction to be press-fitted to the outer peripheral wall of the first housing 20. The second holding portion 6 has a press-fit portion 6*a* widened in the widthwise direction to be press-fitted into the second housing 30. The intermediate portion 9 between the first and the second holding portions 5 and 6 is extended straight from the second holding portion 6 on the inside in the vertical direction, bent to extend towards the first contacting portion 1, turned around towards the second contacting portion 2, further turned around towards the first holding portion 5 to reach the first holding portion 5. The intermediate portion 9 has a first vertical portion 7*c* protruding in a U shape towards the first contacting portion 1. The intermediate portion 9 is inserted into a receiving portion (not shown) of the first housing 20.

In order to press-fit the contact 10*e* into the first and the second housings 20 and 30, the contact 10*e* can be forced into the first and the second housings 20 and 30 by pressing those portions 83 and 84 near the folded portions.

Referring to FIGS. 21 and 23 to 27, description will be made of a double-ended card edge connector as a connector according to a seventh embodiment of this invention.

Figure 21:
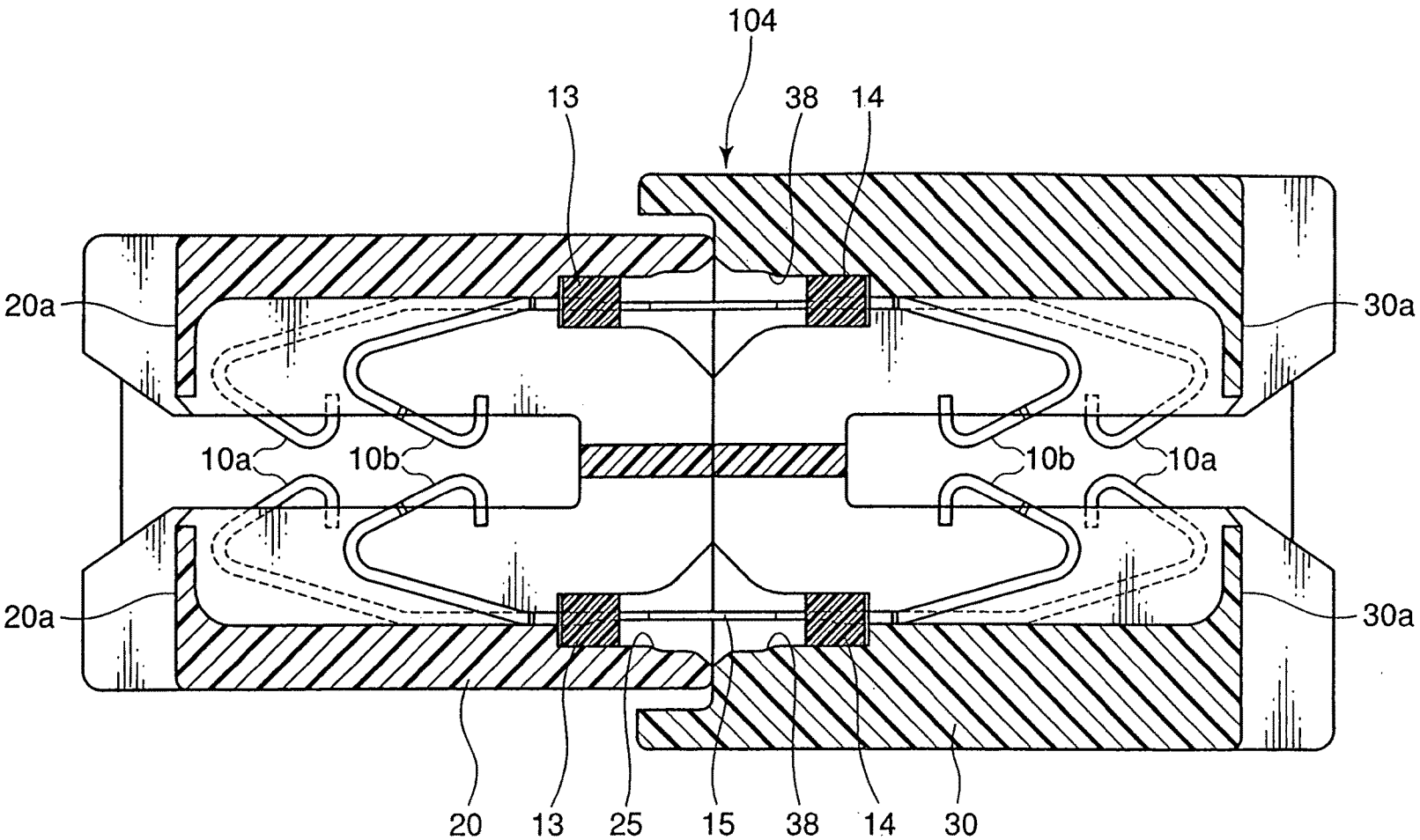
FIG. 21 is a sectional view of a double-ended card edge connector as a connector according to a seventh exemplary embodiment of this invention.
Figure 23:
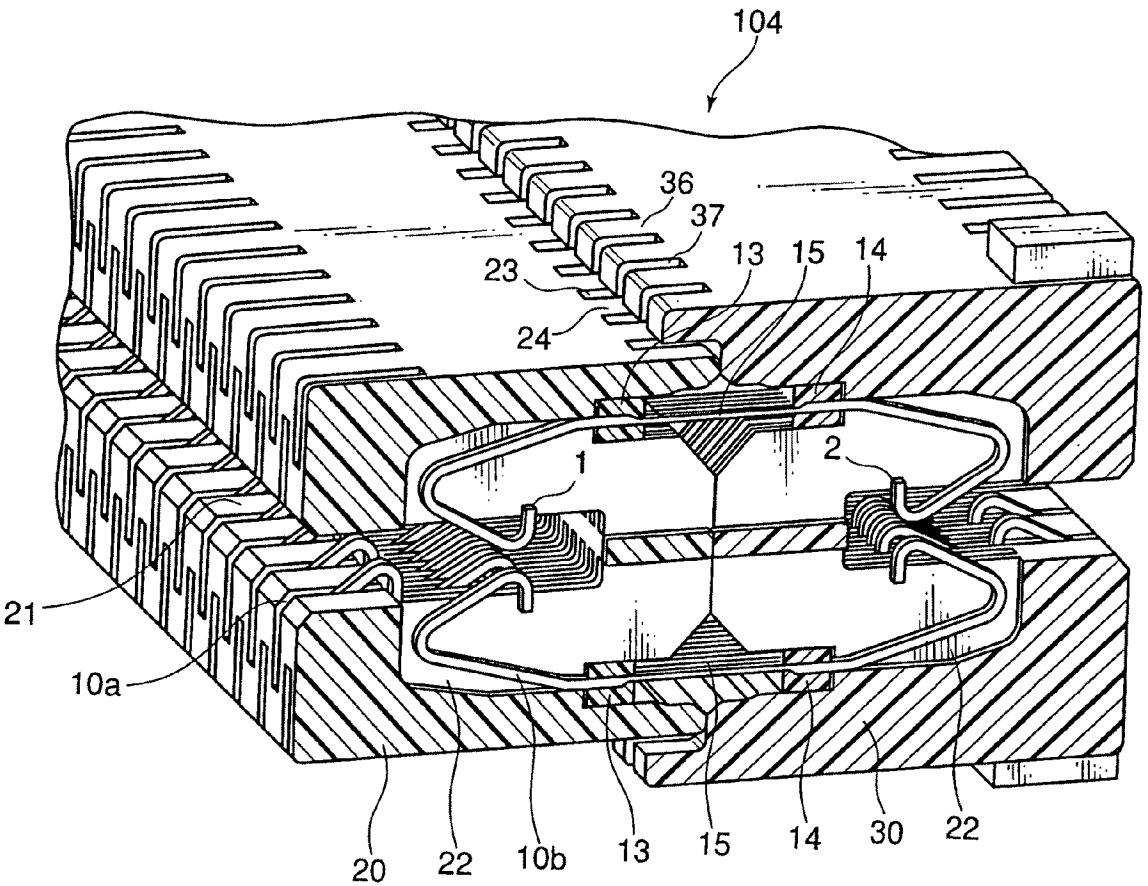
FIG. 23 is a sectional perspective view of a part of the connector illustrated in FIG. 21.
Figure 24:
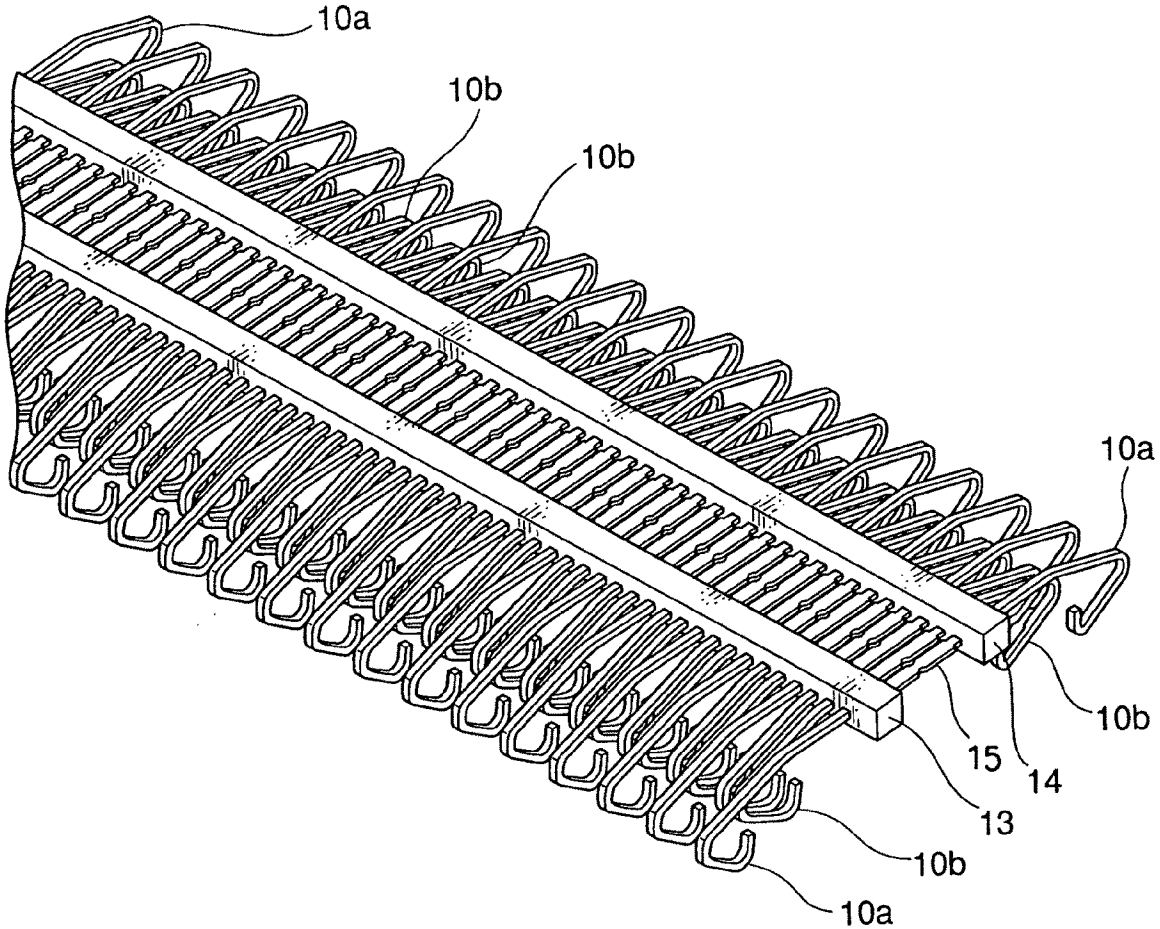
FIG. 24 is a view showing a contact portion of the connector illustrated in FIG. 21.

The double-ended card edge connector 106 illustrated in FIGS. 21 and 23 is different from those described above in that the first and the second contacts 10 in upper and lower rows include ground contacts 10*a* and signal contacts 10*b* different in length from each other. Furthermore, as is different from those described above, the double-ended card edge connector 106 comprises first and second holding members 13 and 14 extending in the widthwise direction and supporting the ground contacts 10*a* and the signal contacts 10*b* in upper and lower contact groups, specifically, supporting the first and the second holding portions 5 and 6 of the ground and the signal contacts 10*a* and 10*b* in the upper and the lower contact groups.

Referring to FIGS. 24 to 27, the group of the first contacts 10*a* and 10*b* in the upper row includes the long ground contacts 10*a* and the short signal contacts 10*b*. The group of the first contacts 10*a* and 10*b* is arranged so that two signal contacts 10*b* are located between two ground contacts 10*a*. The first and the second holding portions 5 and 6 of each ground contact 10*a* are connected by a straight floating portion 15. Similarly, the first and the second holding portions 5 and 6 of each signal contact 10*b* are connected by a straight floating portion 15. The first holding portion 5 of each of the ground contacts 10*a* and the signal contacts 10*b* is molded by insert-molding into the first holding member 13 extending in the widthwise direction. Similarly, the second holding portion 6 is molded by insert-molding into the second holding member 14 extending in the widthwise direction.

Each of the ground contacts 10*a* and the signal contacts 10*b* as the group of the first contacts 10*a* and 10*b* is formed symmetrical with respect to the floating portion 15. The floating portion 15 between the first and the second holding members 13 and 14 is received in the first and the second housings 20 and 30.

Similarly, the group of the second contacts 10*a* and 10*b* in the lower row includes the long ground contacts 10*a* and the short signal contacts 10*b*. The group of the second contacts 10*a* and 10*b* is arranged so that two signal contacts 10*b* are located between two ground contacts 10*a*. The first and the second holding portions 5 and 6 of each ground contact 10*a* are connected by a straight floating portion 15. Similarly, the first and the second holding portions 5 and 6 of each signal contact 10*b* are connected by a straight floating portion 15. The first holding portion 5 of each of the ground contacts 10*a* and the signal contacts 10*b* is molded by insert-molding into the first holding member 13 extending in the widthwise direction. Similarly, the second holding portion 6 is molded by insert-molding into the second holding member 14 extending in the widthwise direction.

Each of the ground contacts 10*a* and the signal contacts 10*b* as the group of the second contacts 10*a* and 10*b* is formed symmetrical with respect to the floating portion 15. The floating portion 15 between the first and the second holding members 13 and 14 is received in the first and the second housings 20 and 30.

Herein, the contact in the related art is different in shape between the contacting portion to be contacted with the pad of the card board 51 and the terminal portion to be mounted to the mother board. Therefore, it is difficult to match the characteristic impedance because the impedance value is different between the case where a signal is supplied through the contacting portion and the case where a signal is supplied through the terminal portion. On the other hand, in the double-ended card edge connector 104 in this embodiment, each of the first and the second contacts 10 has the first and the second contacting portions 1 and 2 formed at opposite ends thereof and is symmetrical in shape with respect to the floating portion 15. Thus, the same characteristic is obtained whether a signal is supplied from the first contacting portion 1 or the second contacting portion 2.

In the double-ended card edge connector 104, the first and the second contacts 10 are fixed to the first and the second housings 20 and 30 in the following manner. Between the first and the second contacting portions 1 and 2 (which will be called an originating contacting portion and a terminating contacting portion) of each of the first and the second contacts 10, insert-molded portions are formed and clamped by the two housings, i.e. the first and the second housings 20 and 30, to be fixed therein. In this manner, card edge connector structures can be formed on opposite ends of the two housings (at the originating point and the terminating point of the contact).

Figure 25A:
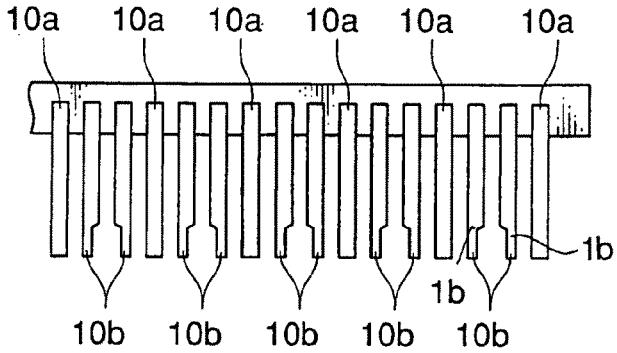
FIG. 25A is a front view of contacts in FIG. 24.
Figure 25B:
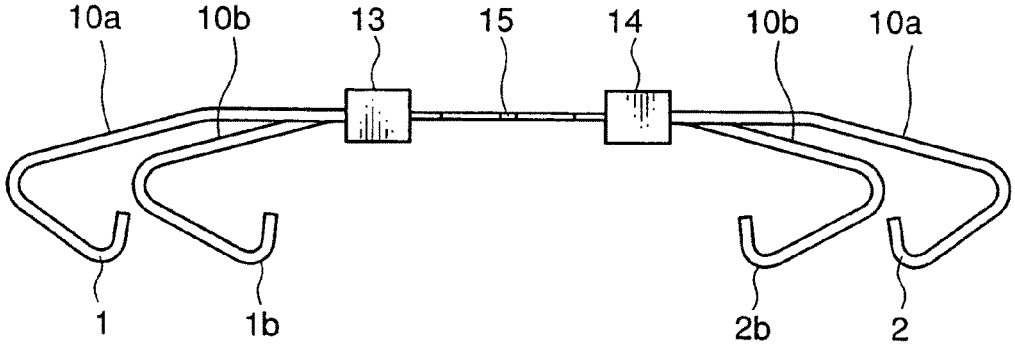
FIG. 25B is a right side view of the contacts in FIG. 24.
Figure 26:
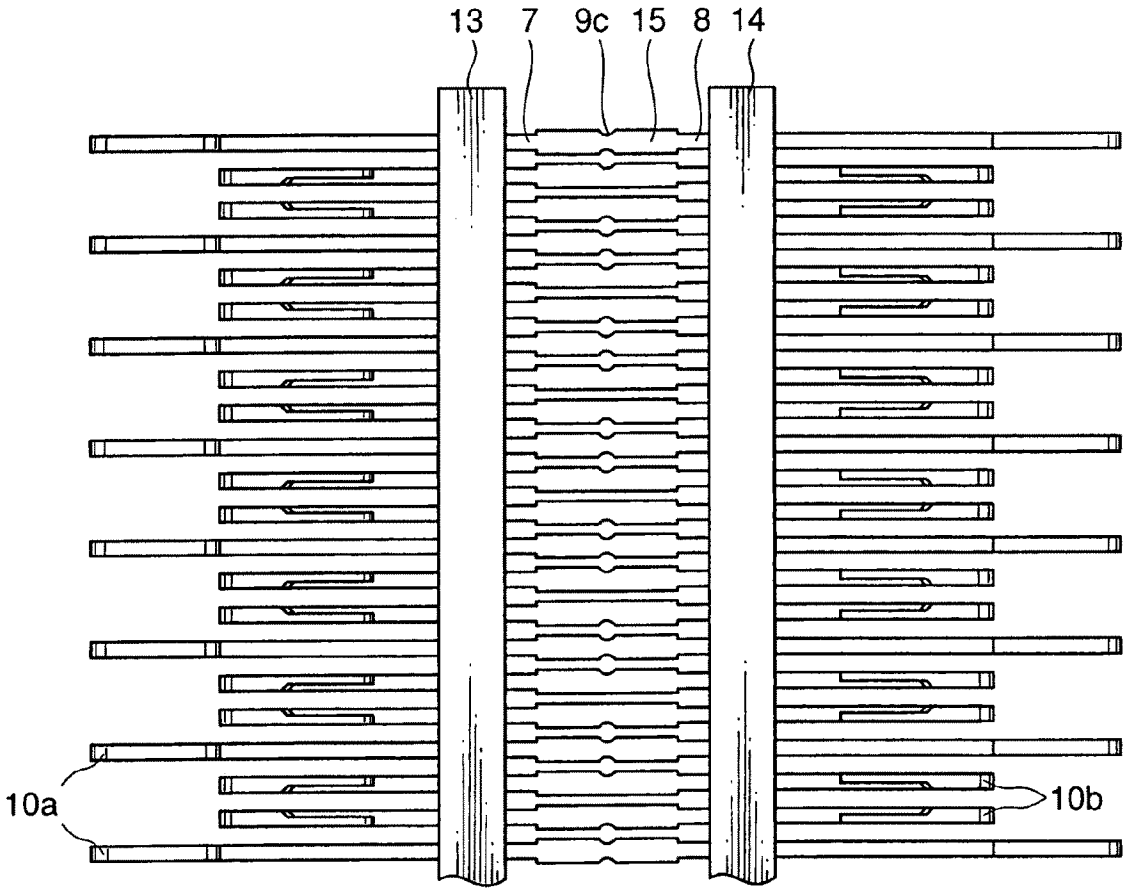
FIG. 26 is a bottom view of the contacts in FIG. 24.
Figure 27:
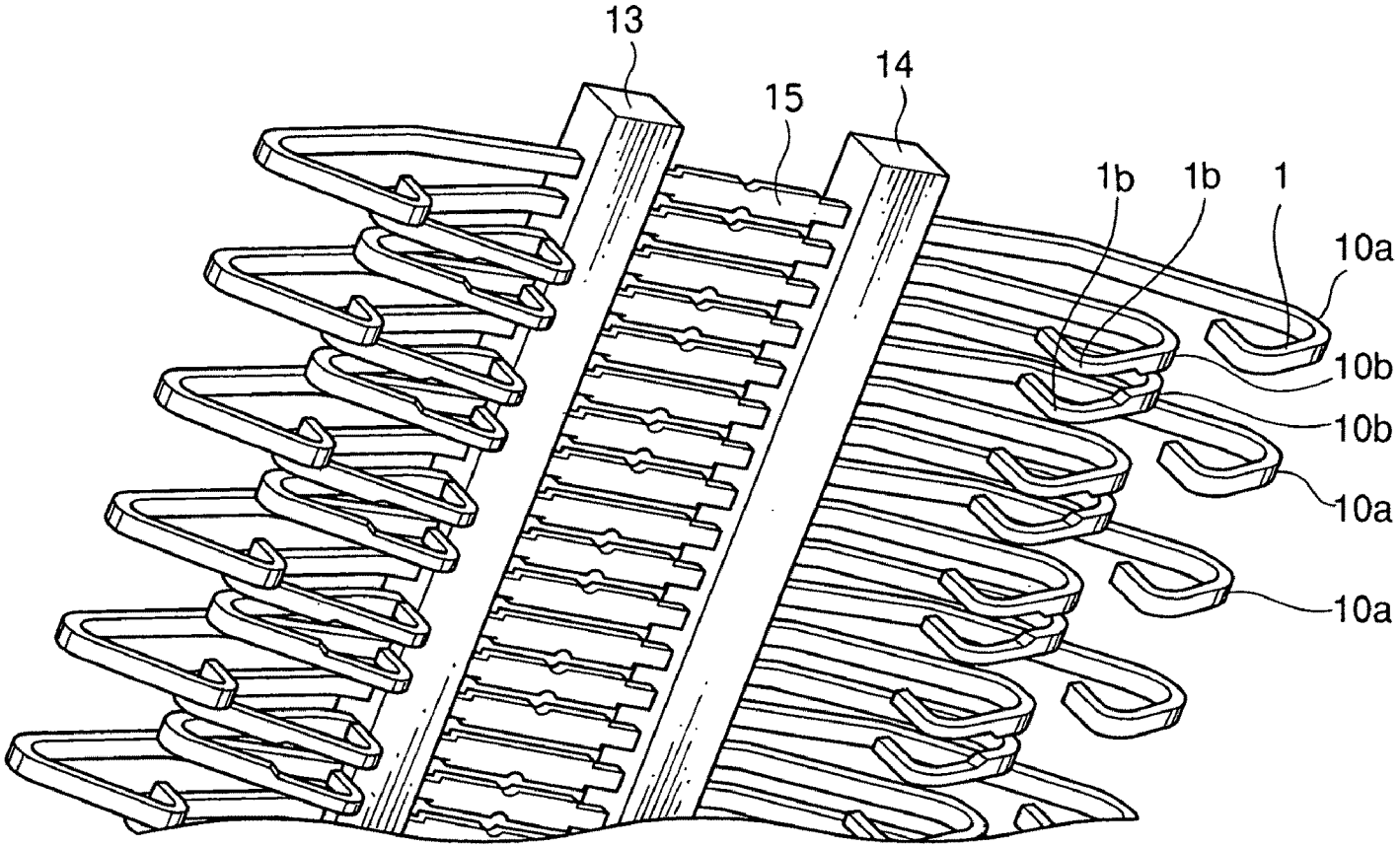
FIG. 27 is a bottom perspective view of a part of the contacts in FIG. 21.

As best shown in FIG. 25A, in the group of the first or the second contacts 10, adjacent ones of the signal contacts 10*b* are formed so that the contacting portions 1*b* on the same side are decentered in directions away from each other.

In the related art, if the contacts are arranged at a narrow pitch, a distance between the signal contacts becomes small. Therefore, the characteristic impedance is inevitably lowered. On the other hand, in the double-ended card edge connector described with reference to FIGS. 21 and 23 to 27, the signal contact 10*b* has an exposed portion at its center so that the characteristic impedance is increased. Thus, the problem of decrease in characteristic impedance in the related art is solved.

In case of the card edge connector narrowed in pitch, misalignment between the card board 51 and the connector causes a significant problem. For example, the contacting portion of the contact may possibly be brought into contact not only with a corresponding conductive pad of the card board 51 but also with a next adjacent pad to cause short-circuiting to occur. On the other hand, in the double-ended card edge connector 104 in this embodiment, the contacts 10*a* and 10*b* are reduced in width only at the first and the second contacting portions 1 and 2 exposed out of the receiving portions 22 and 32 of the first and the second housings 20 and 30. On the other hand, the first and the second spring portions 3 and 4 adjacent to the first and the second contacting portions 1 and 2 are received in the receiving portions 22 and 32 and are not reduced in width. Thus, without causing significant loss in characteristic impedance and in spring property, short-circuiting between adjacent ones of the signal contacts 10*b* is prevented by narrowing only the parts to be contacted with the pads. In addition, outsides of a pair of the signal contacts 10*b* adjacent to each other in the widthwise direction are clamped by a pair of the ground contacts 10*a* so as to enable high-speed transmission.

In the double-ended card edge connector 100, in order to produce a highly-reliable product in view of limitation in pad width and a pitch error, a relatively wide pitch is required. In the double-ended card edge connector 104 in this embodiment, the ground contacts and the signal contacts can be shifted in position frontward and backward. Therefore, as compared with the conventional connector having the same contact pitch, the pad width can be widened. Therefore, the contacts 10*a* and 10*b* can be reduced in pitch with the reliability maintained.

Figure 22:
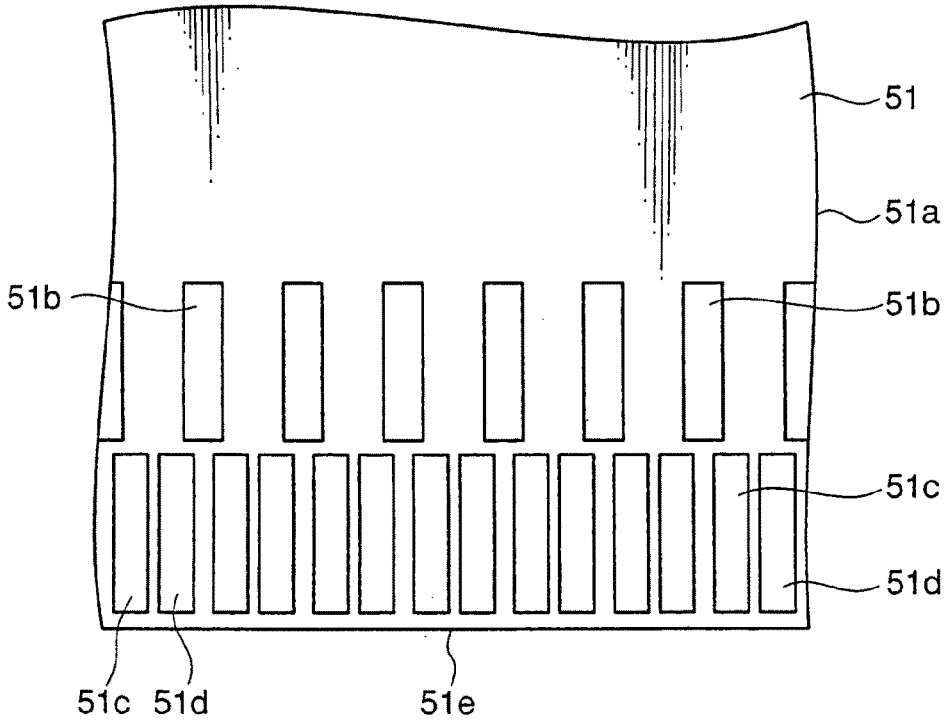
FIG. 22 is a plan view for describing a typical structure of a board used in this invention.

As illustrated in FIG. 22, the subsidiary board, such as the card board 51, is provided with signal pads 51*c* and 51*d* formed near one end 51*e* of an insulating board 51*a* to be fitted to the connector in correspondence to the positions of the signal contacts 10*b*. Furthermore, the card board 51 is provided with a plurality of ground pad 51*b* spaced from the one end 51*e* and corresponding in position to the ground contacts 10*a*. Thus, the two signal contacts are clamped by the two ground contacts in the widthwise direction so that differential signals different in polarity from each other can be stably transmitted at a high speed.

Although detail description is omitted herein, the main board may have structure which is similar to that of the subsidiary board.

Referring to FIGS. 21 and 23 again, the first housing 20 of the double-ended card edge connector 104 is provided with a pair of receiving step portions 25 formed on upper and lower inner walls near the second housing 30 to receive the first holding member 13. Similarly, the second housing 30 is provided with a pair of receiving step portions 38 formed on upper and lower inner walls near the first housing 20 to receive the second holding member 14.

The first housing 20 is provided with protruding portions 24 and recessed portions 23 formed at an overlapping portion with the second housing 30 alternately in the widthwise direction. The second housing 30 is provided with protruding portions 36 and recessed portions 37 formed at an overlapping portion with the first housing 20 alternately in widthwise direction.

The protruding portions 24 and 36 and the recessed portions 23 and 37 are arranged in parallel in the widthwise direction so that the protruding portions 24 and 36 are faced to each other and the recessed portions 23 and 37 are faced to each other. With this structure, the contacts can be exposed to an outside air layer between the first and the second housings 20 and 30.

Herein, the contact in the related art is different in shape between the contacting portion to be contacted with the pad of the card board 51 and the terminal portion to be mounted to the mother board 52. Therefore, it is difficult to match the characteristic impedance because the impedance value is different between the case where a signal is supplied through the contacting portion and the case where a signal is supplied through the terminal portion. On the other hand, in this embodiment, each of the first and the second contacts 10 has the first and the second contacting portions 1 and 2 formed at opposite ends thereof and is symmetrical in shape with respect to the floating portion 15 at the center. Thus, the same characteristic is obtained whether a signal is supplied from the first contacting portion 1 or the second contacting portion 2.

Referring to FIGS. 28 to 31, the description will be made of an adapter connector for a double-ended card edge connector as a connector according to an eighth embodiment of this invention.

In FIGS. 28 to 31, the double-ended card edge connector 105 is different from the double-ended card edge connectors 101, 102, 103, and 104 described above in that the mother board 52 is connected to the first housing 20 via an adapter connector 60 while the card board 51 is connected to the second housing 30.

Figure 30:
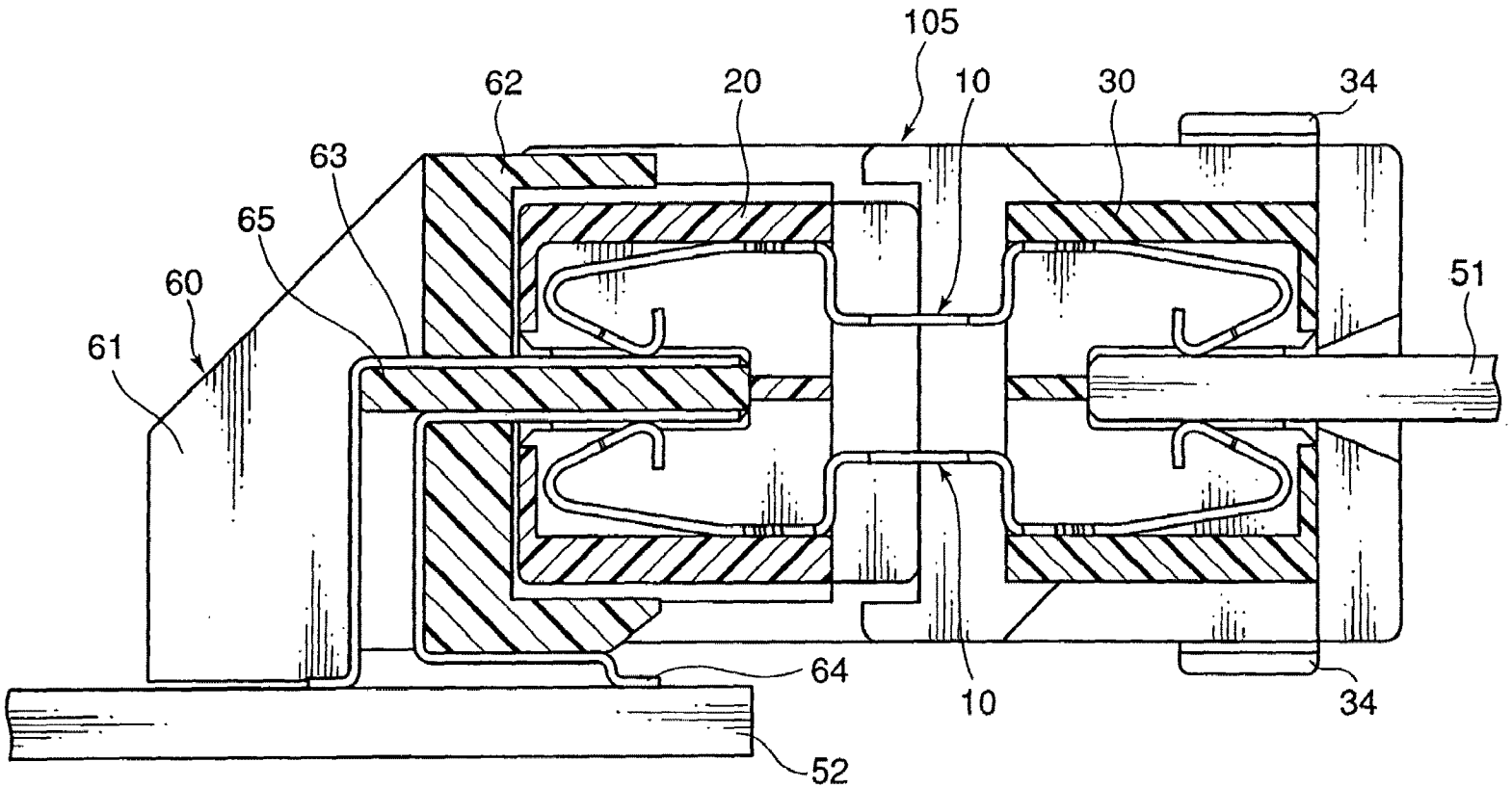
FIG. 30 is a sectional view of the double-ended card edge connector in FIG. 28.

Referring to FIG. 30, the adapter connector 60 is mounted on one surface of the mother board 52. For convenience of description, the side of the adapter connector 60 where a plate-like fitting portion 63 is protruded to be fitted to the connector will be called a front side and the side of a base portion 61 will be called a rear side in the following description.

Figure 31:
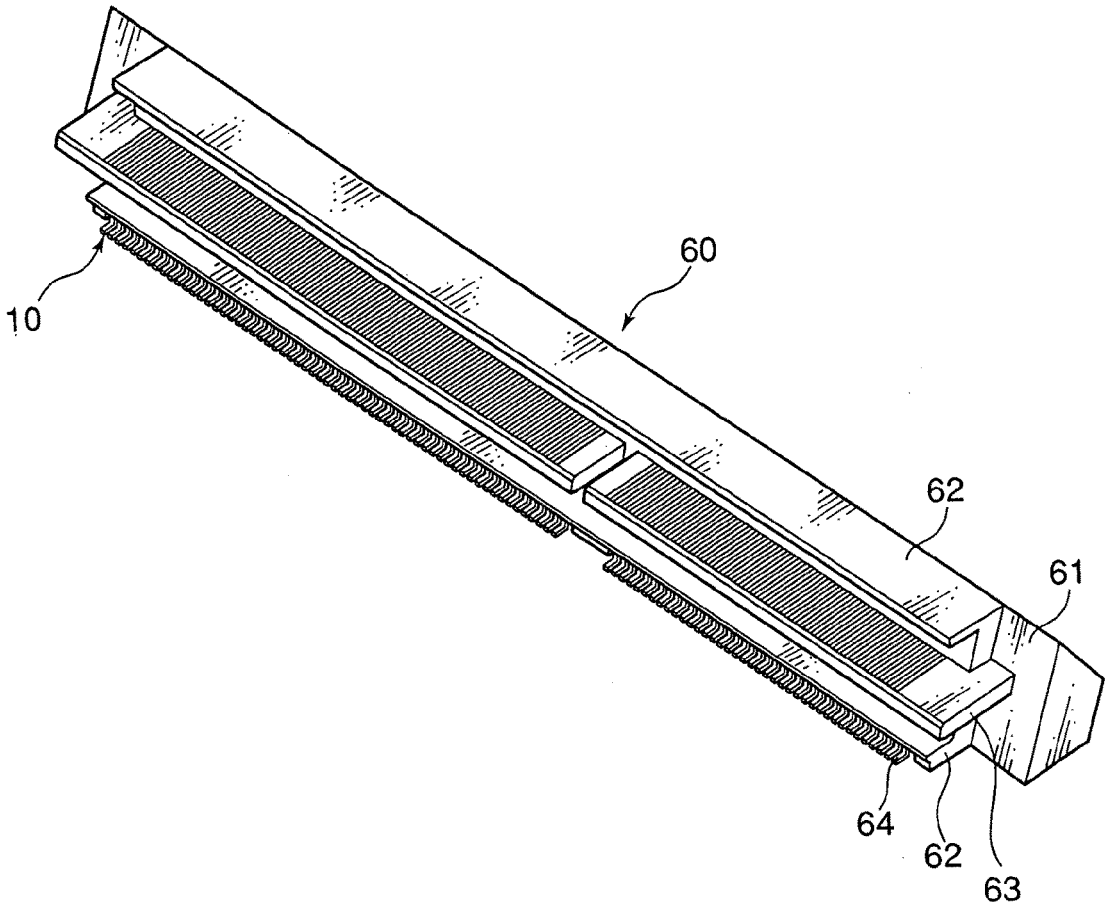
FIG. 31 is a perspective view of an adapter connector for the double-ended card edge connector in FIG. 28.
Figures 32A, 32B, 32C, 32D:
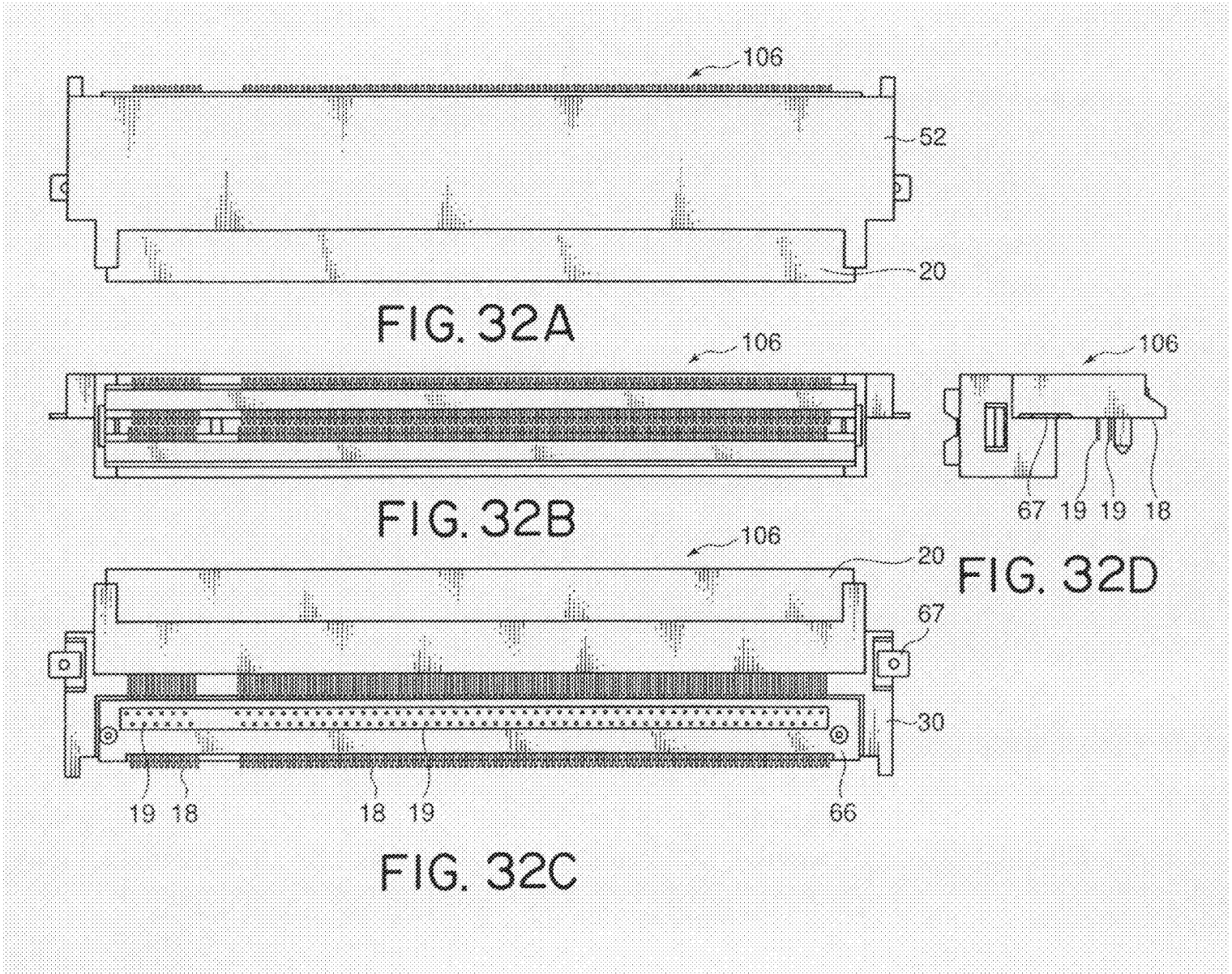
FIG. 32A is a plan view of a connector body of a double-ended card edge connector as a connector according to a ninth exemplary embodiment of this invention.
FIG. 32B is a front view of the double-ended card edge connector in FIG. 32A.
FIG. 32C is a bottom view of the double-ended card edge connector in FIG. 32A.
FIG. 32D is a side view of the double-ended card edge connector in FIG. 32A.

Referring to FIG. 31, the adapter connector 60 comprises a base portion 61 having a trapezoidal section and having a lower surface to be contacted with and mounted to the mother board 52, a housing 62 having a U-shaped section and arranged on the front side of the base portion 61, and a plate-like fitting portion 63 formed at the center of the housing 62 and inserted into the first housing 20 of the double-ended card edge connector 105. On an upper surface of the fitting portion 63, first adapter contacts 65 to be connected to the first contacts 10 on an upper side of the first housing 20 and second adapter contacts 64 to be connected to the second contacts 10 on a lower side of the first housing 20 are arranged. Each of the first adapter contact 65 is extended from the upper surface of the fitting portion 63 through the front surface of the base portion 61 to the mother board 52 and, on the mother board 52, is bent into an L shape to be connected. On the other hand, the second adapter contact 64 is extended from the lower surface of the fitting portion 63 through the rear surface of the housing 62, extended along the lower surface of the housing 62 forward of the housing 62, bent at a front end of the housing 62 to reach the mother board 52, and further extended forward along the one surface of the mother board 52. The adapter contacts 64 and 65 have lower ends fixed to the one surface of the mother board 52 by soldering.

With the above-mentioned structure of the double-ended card edge connector 105, the adapter connector with the SMT or the through hole structure may be fitted to the double-ended card edge connector 105 so as to meet an urgent demand for a hybrid connector having a card edge connector structure on one side and a board mount structure by soldering on the other side.

Thus, with the double-ended card edge connector 105 also, it is possible to connect the card board 51 and the mother board 52.

Referring to FIGS. 32A to 34, description will be made of a card edge connector as a connector according to a ninth embodiment of this invention.

Figure 28:
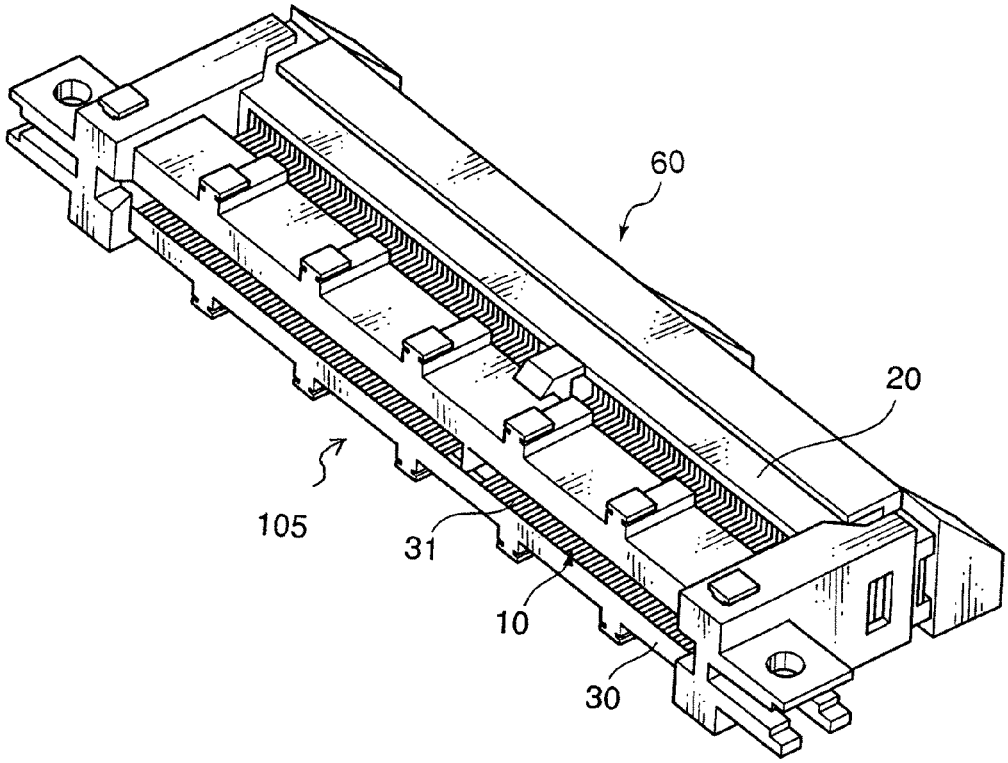
FIG. 28 is a perspective view of a double-ended card edge connector as a connector according to an eighth exemplary embodiment of this invention.
Figure 29A:
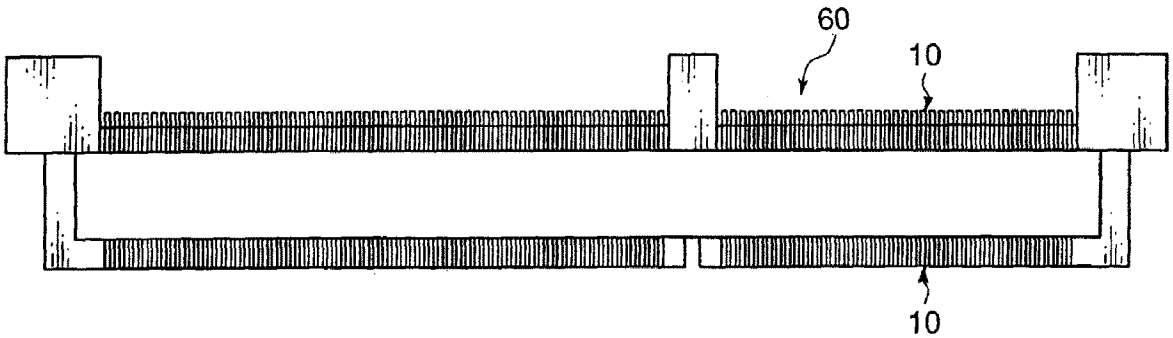
FIG. 29A is a plan view of the double-ended card edge connector in FIG. 28.
Figure 29B:
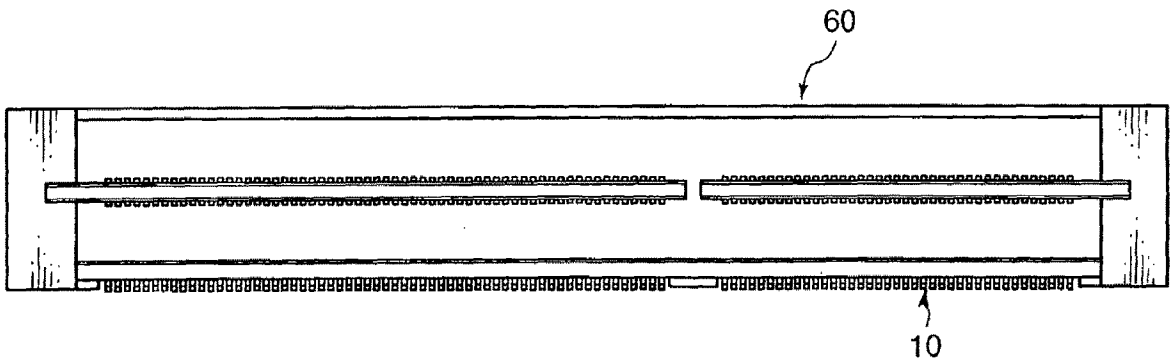
FIG. 29B is a front view of the double-ended card edge connector in FIG. 28.
Figure 29C:
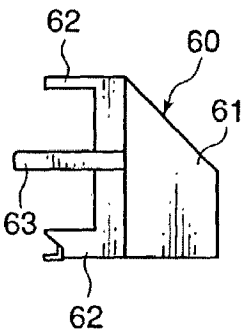
FIG. 29C is a right side view of the double-ended card edge connector in FIG. 28.

In the double-ended card edge connector illustrated in FIG. 28, mounting by soldering can be achieved by combining the adapter connector. On the other hand, in the card edge connector which will hereinafter be described, a demand for a card edge connector structure on one side and connection by soldering on the other side is met by a single connector.

Referring to FIGS. 32A to 34, the card edge connector 106 comprises a first housing 20, a second housing 30 receiving one end of the first housing 20 in a floatable state, and a locator 66 for aligning contact terminals in order to fix first and second contacts 10*f* and 10*g* in upper and lower rows to the mother board.

The first contact 10*f* has a first contacting portion 1, a first spring portion 3, a first holding portion 5, and a first vertical portion 7 which are received in the first housing 20. The first contact 10*f* further has an intermediate portion 16, a second holding portion 17 continuous from the intermediate portion 16, and a surface mount terminal portion 18 having an L shape and surface-mounted to the mother board 52.

The second contact 10*g* has a first contacting portion 1, a first spring portion 3, a first holding portion 5, and a first vertical portion 7 which are received in the first housing 20. The second contact 10*g* further has an intermediate portion 16 folded twice into an S shape and received in the second housing 30, a second holding portion 17 continuous from the intermediate portion 16, and a through hole terminal portion 19 bent downward from the second holding portion 17, passing through the locator 66, and passing through the through hole (not shown) of the mother board 52.

The first contact 10*f* and the second contact 10*g* are held by the first and the second housings 20 and 30 or by the first housing 20 and the locator 66. The second housing 30 and the locator 66 may be united into an integral structure.

Next, an operation of the card edge connector illustrated in FIGS. 32A to 34 will be described.

Figure 33:
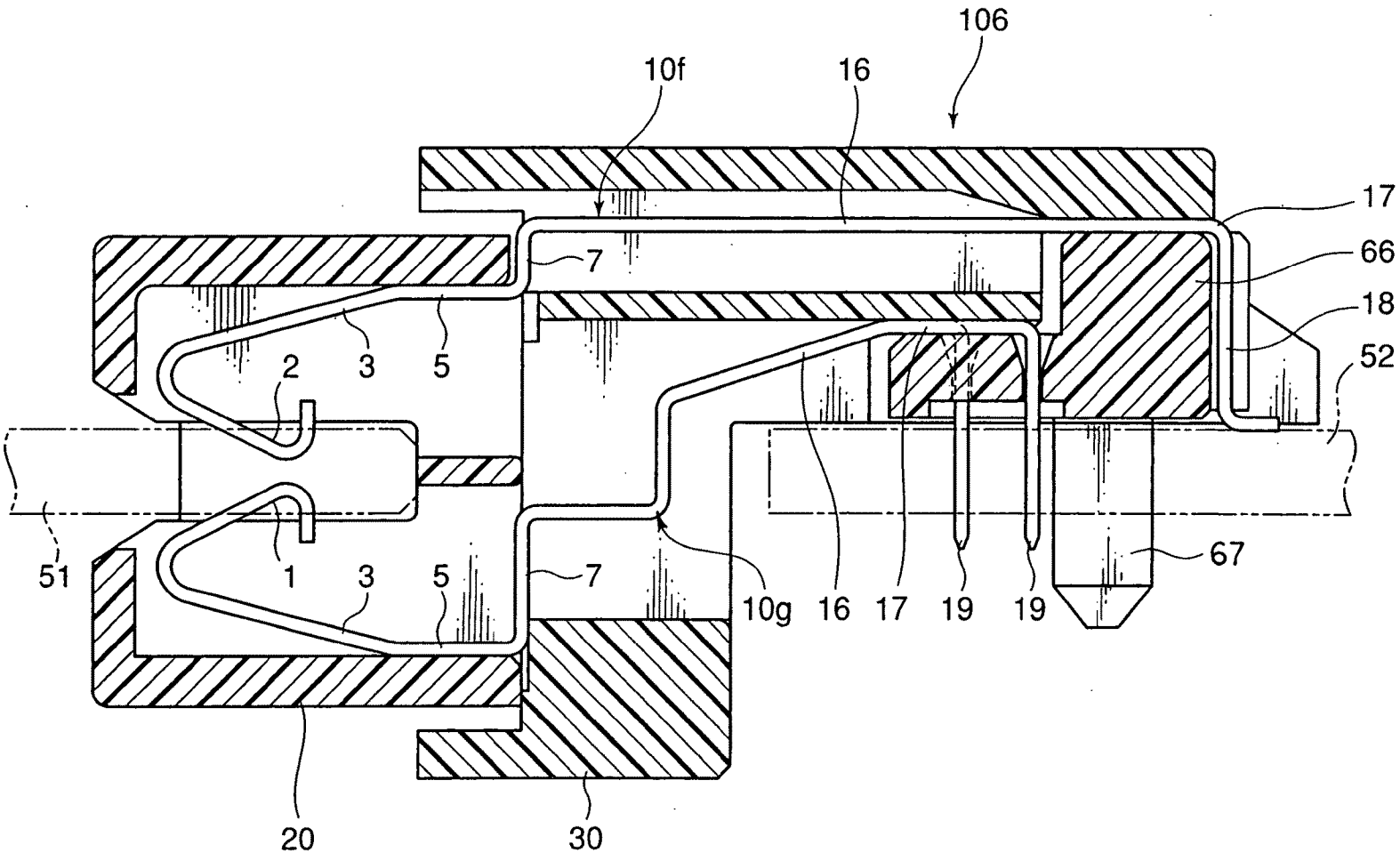
FIG. 33 is a sectional view of the double-ended card edge connector in FIGS. 32A to 32D.
Figure 34:
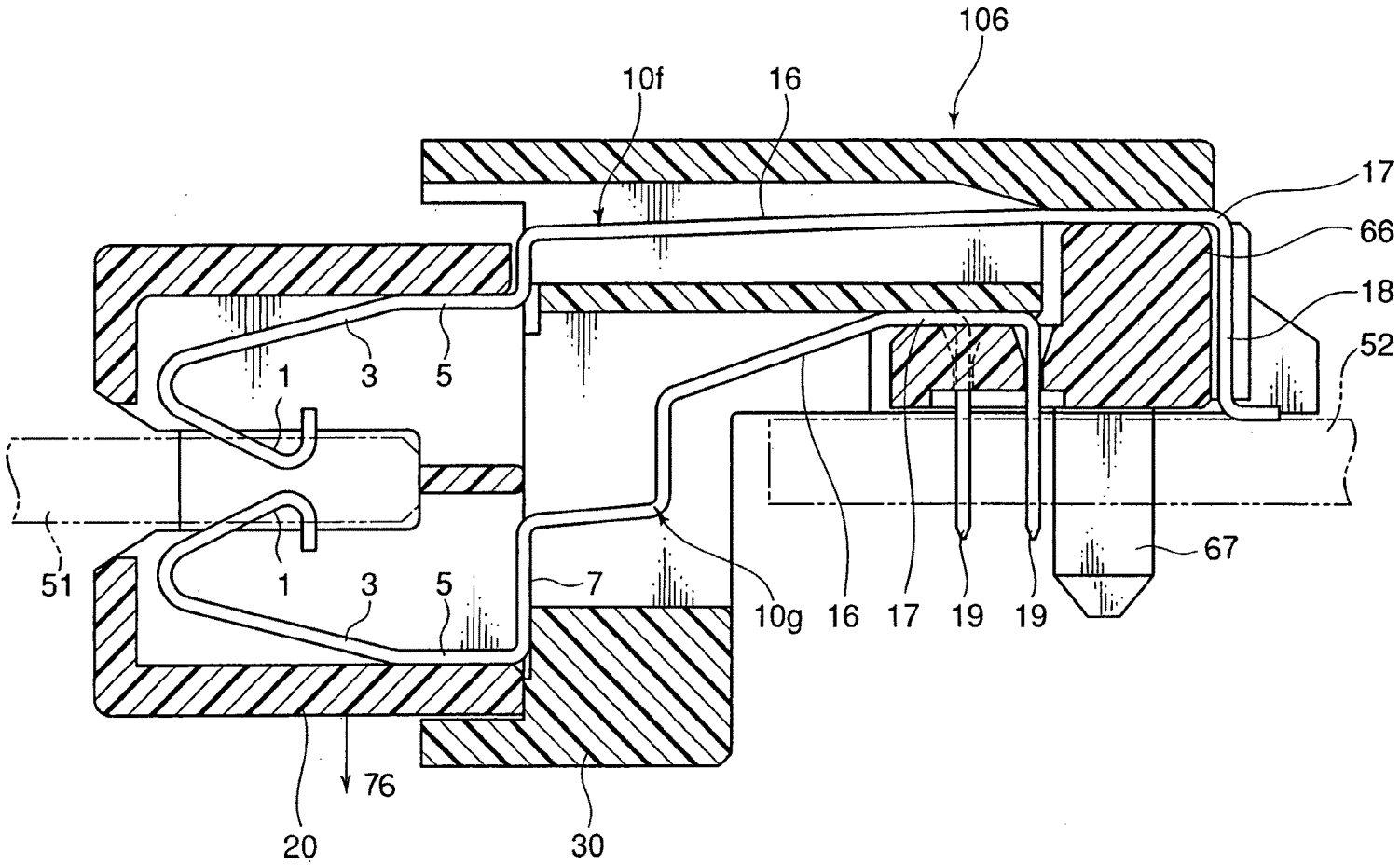
FIG. 34 is a view showing the state where a first housing is floated downward from the state in FIG. 33.

In case where each of the card board 51 and the mother board 52 are horizontally disposed on a single plate as shown in FIG. 33, it is assumed that the first housing 20 is floated downward as depicted by an arrow 76 in FIG. 34. Then, the intermediate portions 16 of the contacts 10*f* and 10*g* are bent downward as floating portions and the card board 51 and the mother board 52 have a positional relationship as illustrated in the figure.

Thus, in the card edge connector illustrated in FIGS. 32A to 34, a mounting error between the card board and the mother board can be absorbed by the connector. In addition, the card board and the mother board can be used in a horizontal or a substantially horizontal positional relationship.

In the related art, in case of the demand for a card edge connector structure on one side and connection by soldering on the other side, the card board and the mother board must be different in level with respect to the thickness direction. On the other hand, in the card edge connector illustrated in FIGS. 32A to 34, a terminal portion near a fitting surface of the card edge is used as a through hole terminal portion 19 while a terminal portion apart from the fitting surface is used as a surface mount terminal 18. In the surface mount terminal portion 18, a through hole is minimized, taking the advantage of the surface mount technology that a through hole for the terminal to pass through is not formed in the board.

If the terminal near the fitting surface of the card edge is used as the surface mount terminal 18 in the above-mentioned structure, the surface mount terminal 18 can not be confirmed from the outside after the card edge connector is soldered to the mother board 52. It is therefore impossible to confirm a soldering condition or to perform a repairing operation (removal of the connector). In this embodiment, however, only the terminal near the fitting surface of the card edge is used as the through hole terminal. With this structure, confirmation of the soldering condition or the repairing operation (removal of the connector) can be carried out from the rear surface (rear side of the connector mounting surface) of the mother board 52.

Accordingly, the double-ended card edge connector in FIGS. 32A to 34 can be used with the card board 51 and the mother board 52 arranged in a horizontal or substantially horizontal positional relationship.

In case of the demand for a card edge structure on one side and connection by soldering on the other side, a mounting error between the boards is a serious problem. However, by providing the floatable intermediate portion 16 between the first contacting portion 1 and each of the terminal portions 18 and 19, the error can be absorbed by the connector.

Referring to FIGS. 35 to 41, modification of the shell will be described.

Figure 35:
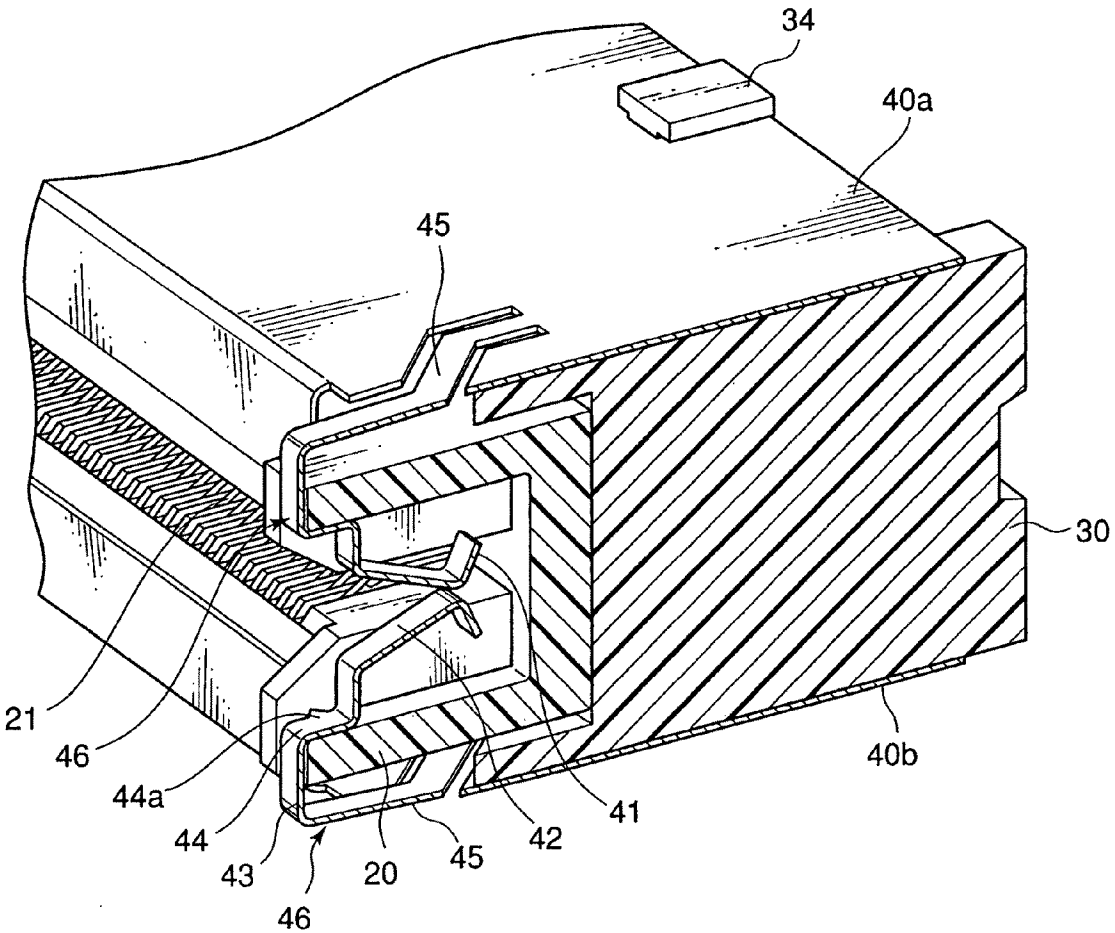
FIG. 35 is a sectional perspective view of a modification of a shell used in this invention, together with a connector.
Figure 36A:
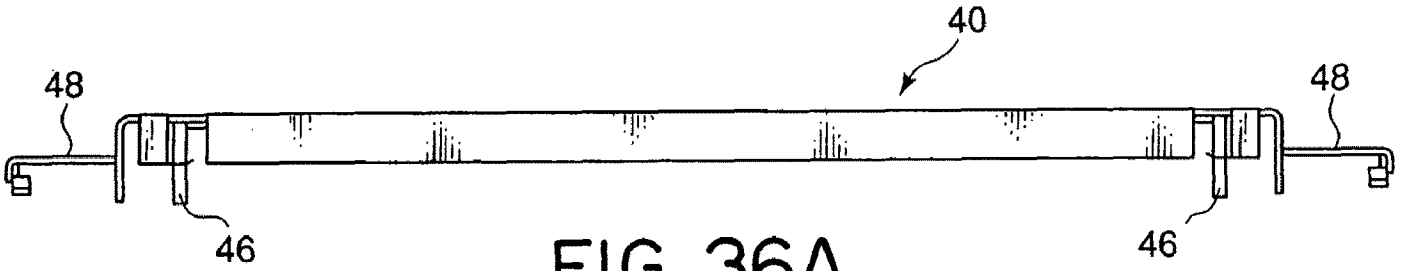
FIG. 36A is a plan view of the shell illustrated in FIG. 35.
Figure 36B:
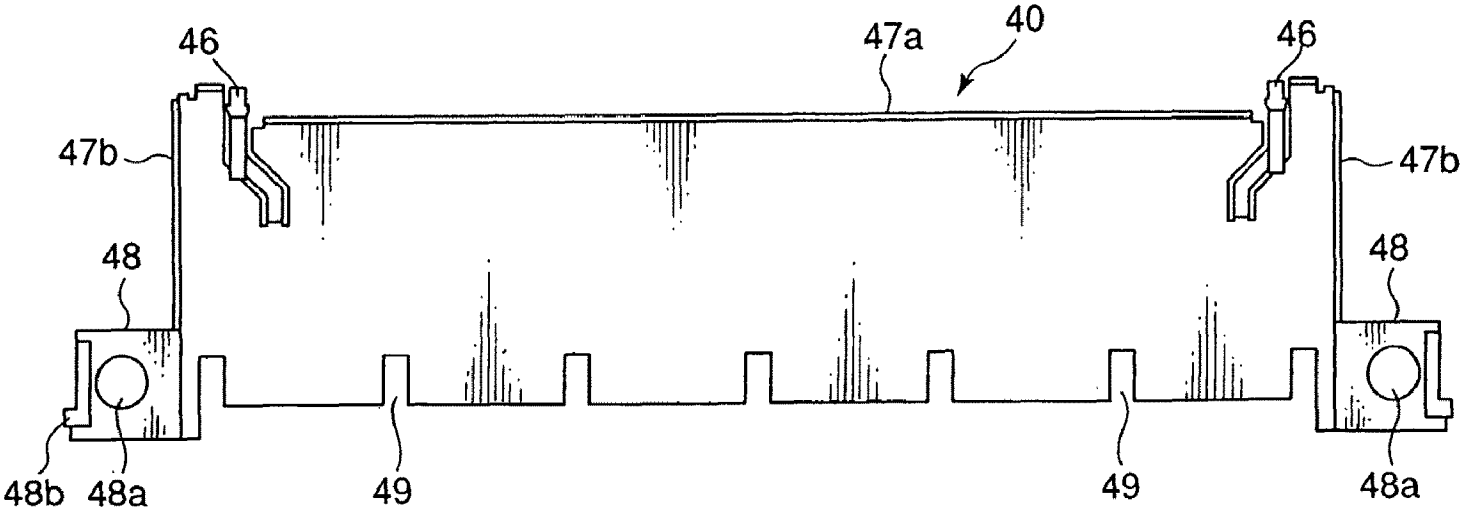
FIG. 36B is a front view of the shell illustrated in FIG. 36A.

Referring to FIGS. 35, 36A, and 36B, the double-ended card edge connector is covered with a metal shell 40 for EMI protection. The shell 40 has a front plate 47*a* on the side of the fitting portion, a pair of shell contacts 46 formed on opposite sides of the front plate 47*a* to be connected to ground of the board, a pair of fixing portions 48 formed on opposite sides and each having a circular hole 48*a* and a contacting portion 48*b*, a pair of side plates 47*b* formed on opposite sides forward of the fixing portions 48, and a plurality of fixing portions 49 as rectangular cut portions formed on the rear side and adapted to be fixed to the second housing 30.

Figure 2:
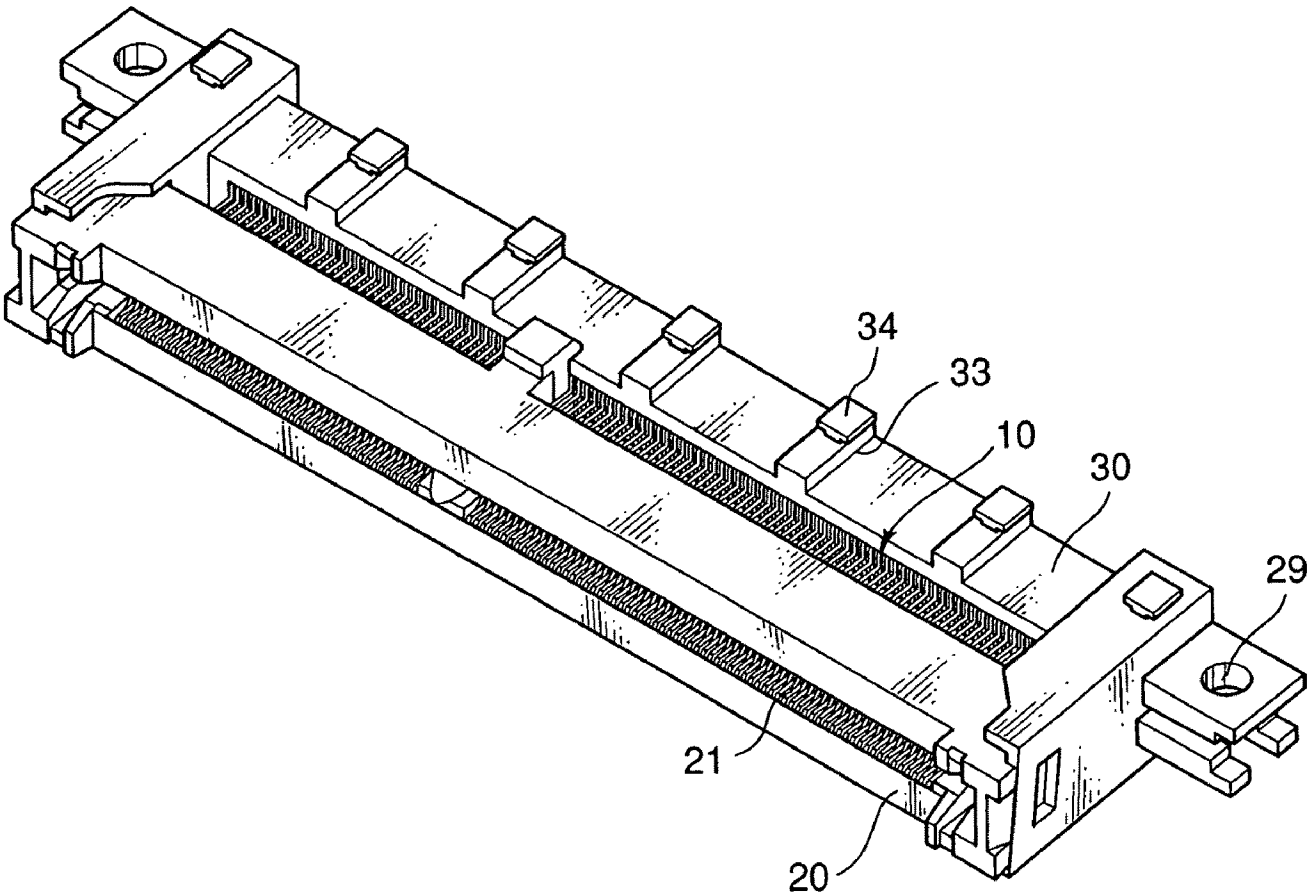
FIG. 2 is a perspective view of a connector body of the double-ended card edge connector illustrated in FIG. 1.
Figure 3A:
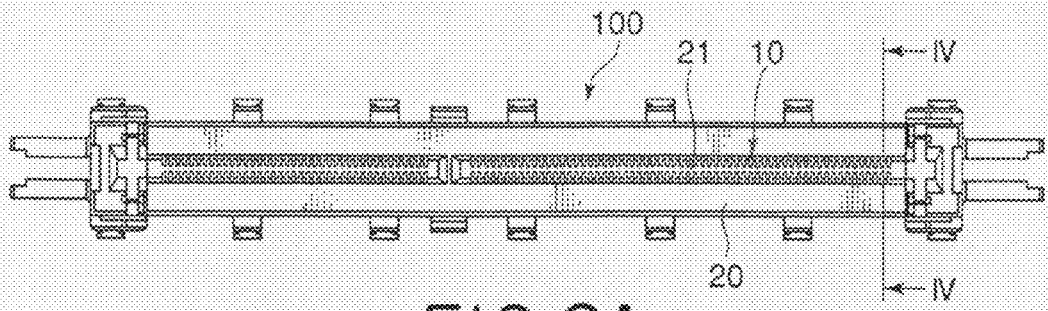
FIG. 3A is a plan view of the connector body illustrated in FIG. 2.
Figure 3B:
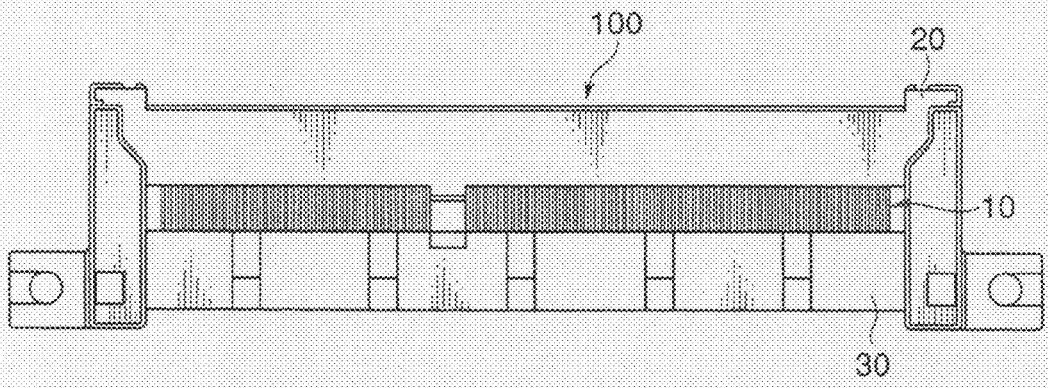
FIG. 3B is a front view of the connector body illustrated in FIG. 2.
Figure 3C:
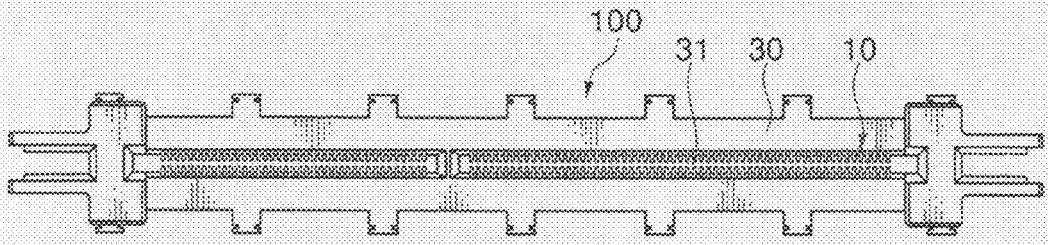
FIG. 3C is a bottom view of the connector body illustrated in FIG. 2.
Figure 3D:
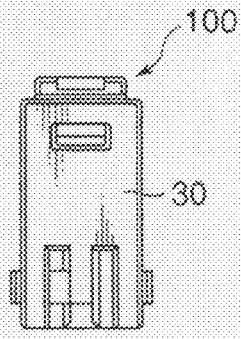
FIG. 3D is a right side view of the connector body illustrated in FIG. 2.

By inserting screws into holes (corresponding to holes 29 made in the second housing 30 as shown in FIG. 2) and the circular holes 48*a*, the shell 40 is fixed to the mother board 52. The contacting portions 48*b* are brought into elastic contact with the pads of the mother board 52. The contacting portions 48*b* may be connected by soldering.

Figure 40:
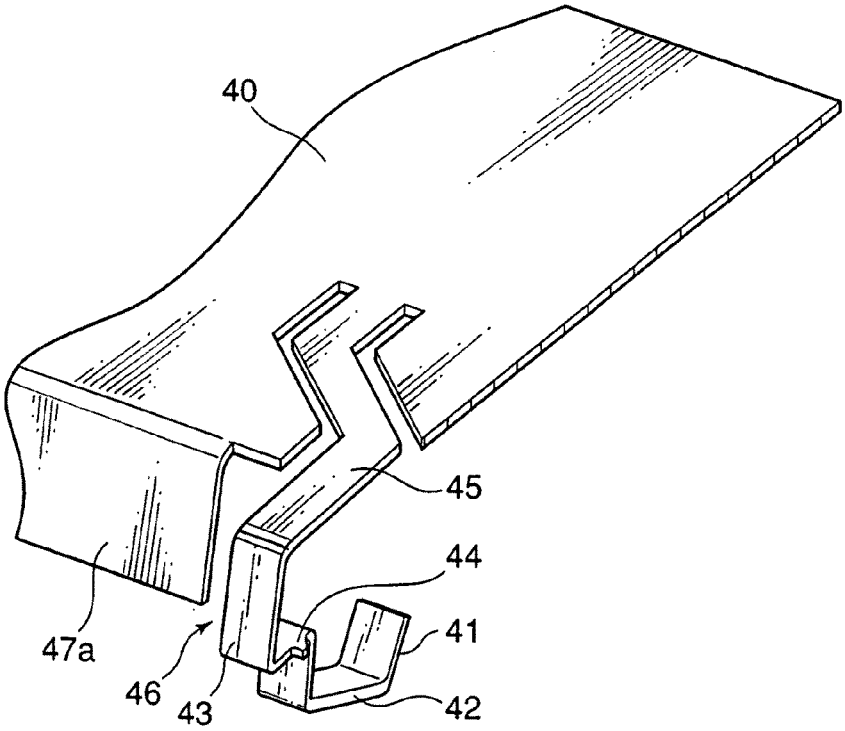
Figure 41:
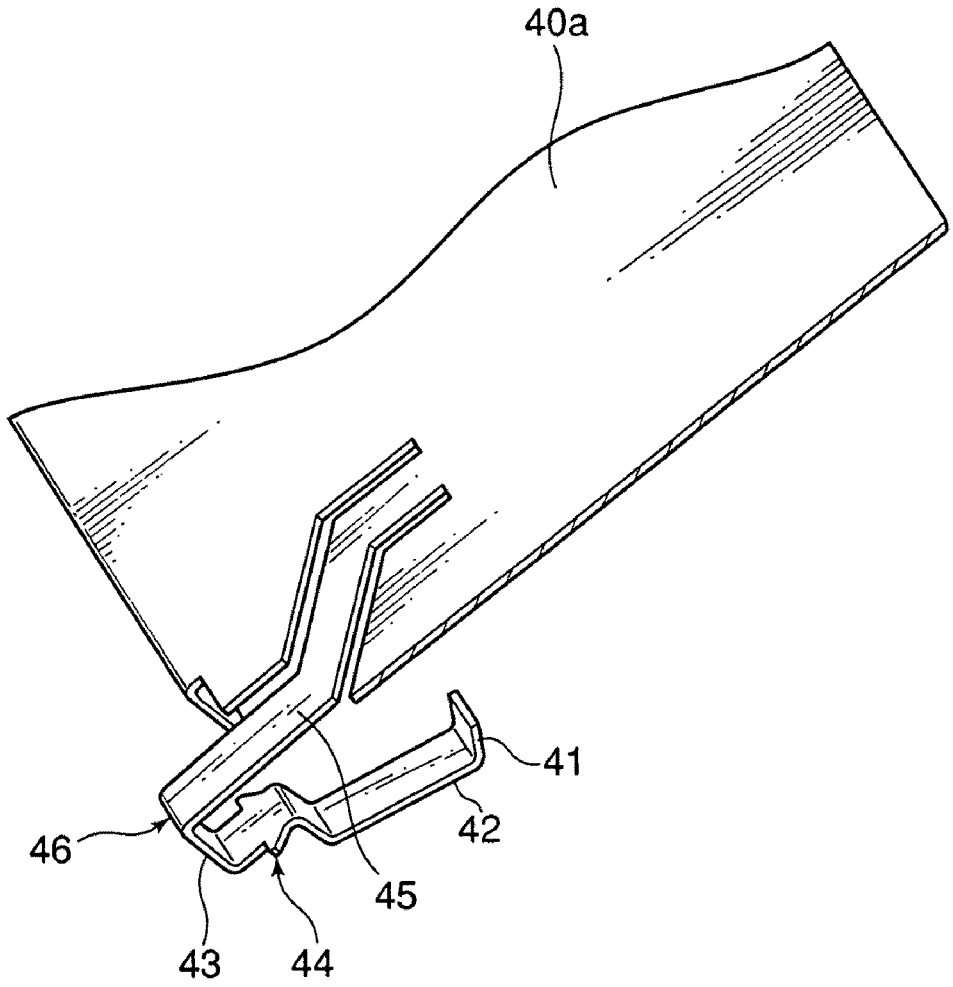

As best shown in FIGS. 35, 40 and 41, each of the shell contacts 46 has an L-shaped contacting portion 41, an L-shaped first spring portion 42 connected to a base of the contacting portion 41, an L-shaped holding portion 43 continuous from the first spring portion 42 and having press-fit portions 44 on opposite sides, and a second spring portion 45 extending from the holding portion 43 to the shell body.

Next, an operation of the shell 40 will be described.

Figure 37:
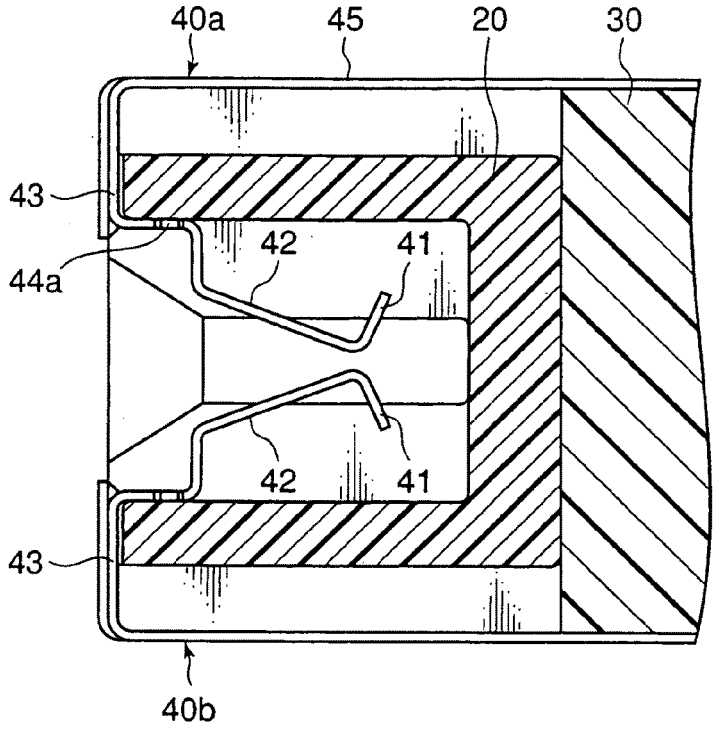
FIGS. 37 and 38 are sectional views for describing an operation of the shell illustrated in FIG. 35.

Referring to FIGS. 35 and 37, the first housing 20 is not moved with respect to the second housing 30. The upper and the lower shells 40*a* and 40*b* cover outside of the housings 20 and 30. The contacting portions 41 of the shell contacts 46 are faced to each other in the vertical direction and exposed in the opening 21.

Figure 38:
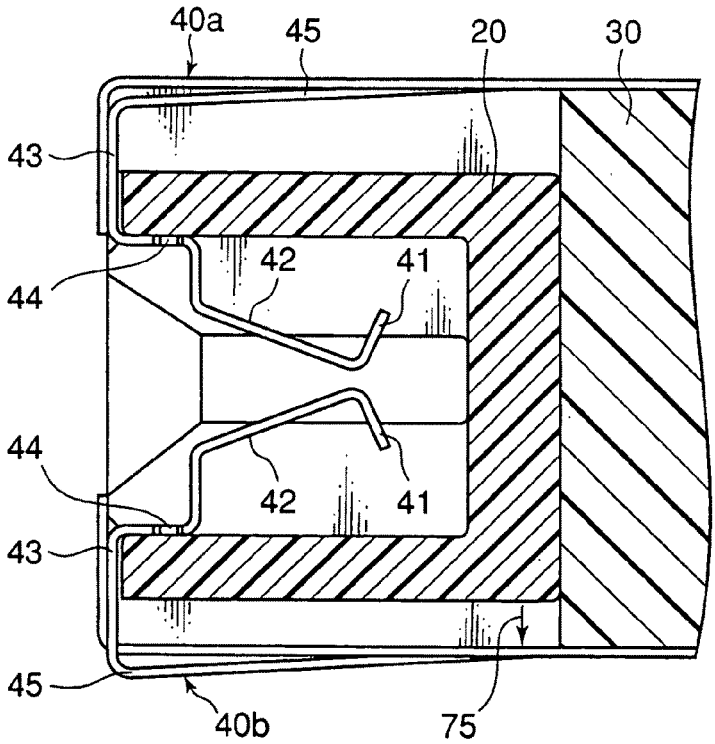
Figure 39:
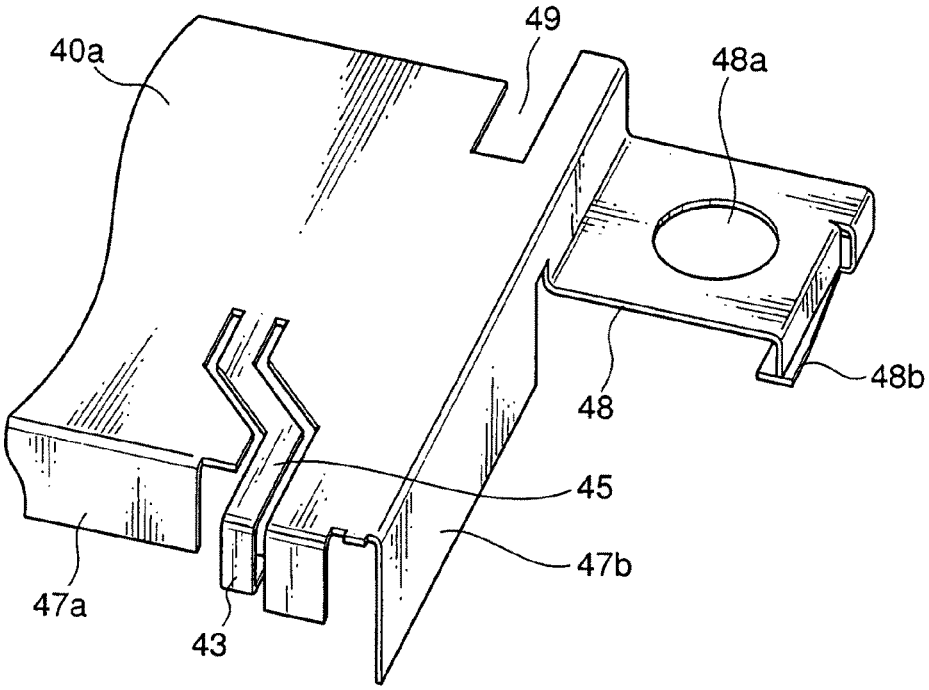
FIGS. 39 to 41 are perspective views showing a part of the shell illustrated in FIGS. 36A and 36B.

When the first housing 20 is applied with a force on its lower side as depicted by an arrow 75 in FIG. 38, the shell contact 46 is moved together with the housing 20. At this time, the first housing 20 is continuously applied with an upward force by the second spring portion 45. When the force is removed, the first housing 20 is returned to its initial position (see FIG. 37). In the illustrated example, the shell contact 46 is formed on the front side of the shell 40. As a modification, similar contacts may further be formed on the rear side to be connected to a board inserted into the second housing 30.

The above-mentioned shell 40 may be provided on any of the double-ended card edge connectors 100, 101, 102, 103, 104, and 105. With the double-ended card edge connectors 100, 101, 102, 103, 104, and 105 with the shell 40, the press-fit portion 44 is formed in the vicinity of the first spring portion 42 at the shell contact 46. Furthermore, the second spring portion 45 as the spring is formed at the part connecting the press-fit portion 44 to the body of the shell 40. With this structure, even if the fitting portion of the double-ended card edge connector is floated, the spring at the part connecting the press-fit portion 44 to the body of the shell 40 is deformed in conformity with the floating. Therefore, the contacting portion of the shell 40 is not varied with respect to the first housing 20. Thus, stable contact can be assured with respect to the pads of the card board 51.

As described above, in the double-ended card edge connectors 100, 101, 102, 103, 104, and 105 having the floating function, a soldering operation in mounting the connector to the board is unnecessary. In addition, positioning error between the boards can be absorbed by the connector. Furthermore, the boards can be disposed at a horizontal position. The apparatus using the connector can be reduced in thickness.

In the double-ended card edge connectors 100, 101, 102, 103, 104, and 105, the same characteristic impedance is achieved whether a signal is supplied from one side or the other side of the connector and a narrow pitch arrangement is possible while keeping the reliability of contact.

In the double-ended card edge connectors 100, 101, 102, 103, 104, and 105 having the floating function, even if the fitting surface of the card connector is floated by the floating structure, the contacting portion of the shell 40 is not varied in position with respect to the pads of the board so as to achieve stable contact. In addition, the characteristic impedance can be maintained excellent. These connectors are adaptable to a high-speed signal.

The double-ended card edge connector described above can be used as a connector for connecting a card board and a mother board in a personal computer or an electronic apparatus.

Hereinafter, various exemplary modes of embodying this invention will be given.

1. A connector for connecting two connection objects (51, 52), comprising:

a plurality of contacts (10); and a housing (20, 30) holding the contacts (10);

wherein each of the contacts (10) includes:

a first contacting portion (1, 1*b*) to be connected to one of the connection objects;

a first holding portion (5) continuous from the first contacting portion (1, 1*b*);

a second contacting portion (2, 2*b*) to be connected to the other connection object;

a second holding portion (6) continuous from the second contacting portion (2, 2*b*); and a connecting portion (9) connecting the first holding portion (5) and the second holding portion (6);

wherein the housing comprises:

a first housing (20) holding the first holding portion (5) and receiving the first contacting portion (1, 1*b*); and a second housing (30) separate from the first housing, holding the first holding portion (6), and receiving the second contacting portion (2, 2*b*); and wherein the first housing (20) is held by the connecting portion (9) to be movable relative to the second housing (30) in a fitting and removing direction with the connection object or a direction intersecting the fitting and removing direction.

2. The connector according to the first mode, further comprising:

a first holding member (13) integrally holding the first holding portion (5) molded therein; and a second holding member (14) integrally holding the second holding portion (6) molded therein.

3. The connector according to the first mode, further comprising a shell (40, 40*a*, 40*b*) covering the first housing (5) and the second housing (6), wherein the shell (40, 40*a*, 40*b*) includes at least one contacting portion (46) having elasticity and adapted to be connected to at least one of the two connection objects.

4. The connector according to the first mode, wherein the one connection object is a board (51) having a pad (51*b*) formed on each of opposite surfaces at its end portion.

5. The connector according to the fourth mode, wherein the one connection object is a card board (51), and the other connection object is a mother board (52).

6. The connector according to the fifth mode, further comprising an adapter connector (60), wherein the mother board (52) is connected to the connector through the adapter connector (60).

7. The connector according to the first mode, wherein the first contacting portion (1, 1*b*) and the second contacting portion (2, 2*b*) are decentered with respect to each other.

8. The connector according to the first mode, wherein the connecting portion (9) includes a floating portion (11) which allows the first holding portion (5) and the second holding portion (6) to be movable with respect to each other.

9. The connector according to the eighth mode, wherein the floating portion (11) is smaller in sectional area than each of the first holding portion (5) and the second holding portion (6).

10. The connector according to the first mode, wherein each of the contacts (10) includes a deformable folded portion between the first holding portion (5) and the second holding portion (6).

11. The connector according to the first mode, further comprising a conductive shell (40*a*, 40*b*) coupled to the housing (20, 30), wherein the shell (40*a*, 40*b*) includes a shell contact (46) disposed on the side of a fitting portion of the connector, and wherein the shell contact (46) comprises:

a shell body covering the housing (20, 30);

an L-shaped contacting portion (41);

an L-shaped first spring portion (42) continuous from the L-shaped contacting portion (41);

an L-shaped holding portion (44, 45) continuous from the first spring portion (42); and a second spring portion (45) extending from the holding portion (44, 45) to the shell body.

Hereinafter, exemplary effects of this invention will be mentioned.

1. In the card edge connector, an error in mounting position can be absorbed by the connector by providing a floating portion.

2. The same characteristic can be obtained whether a signal is supplied from the side of the subsidiary board or the side of the main board.

3. Without causing significant loss in characteristic impedance of the contact or in spring property of the contact, short-circuiting is prevented.

4. In the card edge connector having a shell, stable contact can be achieved.

While the present invention has thus far been described in connection with the exemplary embodiments thereof, it will readily be possible for those skilled in the art to put this invention into practice in various other manners.

What is claimed is:

1. A connector for connecting first and second connection objects, comprising:

a plurality of contacts;

a housing holding the contacts; and a conductive shell coupled to the housing;

wherein each of the contacts includes:

a first contacting portion to be connected to one of the connection objects;

a first holding portion continuous from the first contacting portion;

a second contacting portion to be connected to the other connection object;

a second holding portion continuous from the second contacting portion; and a connecting portion connecting the first holding portion and the second holding portion;

wherein the housing comprises:

a first housing holding the first holding portion and receiving the first contacting portion; and a second housing separate from the first housing, holding the second holding portion, and receiving the second contacting portion;

wherein the first housing is held by the connecting portion to be movable relative to the second housing in a fitting and removing direction with the first connection object or a direction intersecting the fitting and removing direction;

wherein the shell includes a shell contact disposed on the side of a fitting portion of the connector, and wherein the shell contact comprises:

a shell body covering the housing;

an L-shaped contacting portion;

an L-shaped first spring portion continuous from the L-shaped contacting portion;

an L-shaped holding portion continuous from the first spring portion; and a second spring portion extending from the L-shaped holding portion to the shell body.

2. The connector according to claim 1, further comprising:

a first holding member integrally holding the first holding portion molded therein; and a second holding member integrally holding the second holding portion molded therein.

3. The connector according to claim 1, wherein the shell includes at least one contacting portion having elasticity and adapted to be connected to at least one of the first and second connection objects.

4. The connector according to claim 1, wherein the first connection object is a board having a pad formed on each of opposite surfaces at its end portion.

5. The connector according to claim 4, wherein the first connection object is a card board, and wherein the second connection object is a mother board.

6. The connector according to claim 5, further comprising an adapter connector, wherein the mother board is connected to the connector through the adapter connector.

7. The connector according to claim 1, wherein the first contacting portion and the second contacting portion are decentered with respect to each other.

8. The connector according to claim 1, wherein the connecting portion includes a floating portion which allows the first holding portion and the second holding portion to be movable with respect to each other.

9. The connector according to claim 8, wherein the floating portion is smaller in sectional area than each of the first holding portion and the second holding portion.

10. The connector according to claim 1, wherein each of the contacts includes a deformable folded portion between the first holding portion and the second holding portion.

11. A connector for connecting first and second connection objects, comprising:

a plurality of contacts; and a housing holding the contacts;

wherein each of the contacts includes:

a first contacting portion to be connected to one of the connection objects;

a first holding portion continuous from the first contacting portion;

a second contacting portion to be connected to the other connection object;

a second holding portion continuous from the second contacting portion; and a floating portion between the first holding portion and the second holding portion;

wherein the floating portion comprises an intermediate portion including at least one folded portion;

wherein the intermediate portion comprises portions which are different from one another in sectional area;

wherein the housing comprises:

a first housing holding the first holding portion and receiving the first contacting portion; and a second housing separate from the first housing, holding the second holding portion, and receiving the second contacting portion; and wherein the first housing is held by the floating portion to be movable relative to the second housing in a fitting and removing direction with the first connection object or a direction intersecting the fitting and removing direction.

12. The connector according to claim 11, further comprising:

a first holding member integrally holding the first holding portion molded therein; and a second holding member integrally holding the second holding portion molded therein.

13. The connector according to claim 11, further comprising a shell covering the first housing and the second housing, wherein the shell includes at least one contacting portion having elasticity and adapted to be connected to at least one of the first and second connection objects.

14. The connector according to claim 11, wherein the first connection object is a board having a pad formed on each of opposite surfaces at its end portion.

15. The connector according to claim 14, wherein the first connection object is a card board, and wherein the second connection object is a mother board.

16. The connector according to claim 15, further comprising an adapter connector, wherein the mother board is connected to the connector through the adapter connector.

17. The connector according to claim 11, wherein the first contacting portion and the second contacting portion are decentered with respect to each other.

18. The connector according to claim 11, wherein the floating portion allows the first holding portion and the second holding portion to be movable with respect to each other.

19. The connector according to claim 18, wherein the floating portion is smaller in sectional area than each of the first holding portion and the second holding portion.

* * * * *